US009435528B2

(12) United States Patent
Reier

(10) Patent No.: US 9,435,528 B2
(45) Date of Patent: Sep. 6, 2016

(54) LED LAMP WITH LED ASSEMBLY RETENTION MEMBER

(71) Applicant: Cree, Inc., Durham, NC (US)

(72) Inventor: Bart Peter Reier, Cary, NC (US)

(73) Assignee: Cree, Inc., Durham, NC (US)

( * ) Notice: Subject to any disclaimer, the term of this patent is extended or adjusted under 35 U.S.C. 154(b) by 99 days.

(21) Appl. No.: 14/254,390

(22) Filed: Apr. 16, 2014

(65) Prior Publication Data

US 2015/0300619 A1 Oct. 22, 2015

(51) Int. Cl.

| | |
|---|---|
| ***F21V 19/00*** | (2006.01) |
| ***F21V 29/503*** | (2015.01) |
| ***F21K 99/00*** | (2016.01) |
| ***F21V 23/00*** | (2015.01) |
| ***F21V 29/77*** | (2015.01) |
| *F21Y 101/02* | (2006.01) |
| *F21V 3/00* | (2015.01) |
| *F21Y 111/00* | (2016.01) |

(52) U.S. Cl.

CPC ..... *F21V 29/503* (2015.01); *F21K 9/135* (2013.01); *F21K 9/90* (2013.01); *F21V 19/003* (2013.01); *F21V 23/006* (2013.01); *F21V 29/773* (2015.01); *F21V 3/00* (2013.01); *F21Y 2101/02* (2013.01); *F21Y 2111/005* (2013.01)

(58) Field of Classification Search

CPC ... F21V 29/503; F21V 19/003; F21V 29/773
See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |
| 6,227,679 | B1 | 5/2001 | Zhang et al. |
| 6,234,648 | B1 | 5/2001 | Borner et al. |
| 6,250,774 | B1 | 6/2001 | Begemann et al. |
| 6,276,822 | B1 | 8/2001 | Bedrosian et al. |
| 6,465,961 | B1 | 10/2002 | Cao |
| 6,523,978 | B1 | 2/2003 | Huang |

(Continued)

FOREIGN PATENT DOCUMENTS

| | | |
|---|---|---|
| EP | 1058221 A2 | 12/2000 |
| EP | 0890059 B1 | 6/2004 |

(Continued)

*Primary Examiner* — Elmito Breval

(74) *Attorney, Agent, or Firm* — Dennis J. Williamson; Moore & Van Allen PLLC

(57) ABSTRACT

A LED lamp includes an at least partially optically transmissive enclosure and a base. A LED assembly having a plurality of LEDs is located in the enclosure where the LEDs are operable to emit light when energized through an electrical path from the base. A heat sink has a heat dissipating portion that is at least partially exposed to the ambient environment and a heat conducting portion that is thermally coupled to the at least one LED assembly. The LED assembly is mounted on the heat conducting portion under radial tension. A retention member restrains the LED assembly from moving in an axial direction relative to the heat conducting portion.

22 Claims, 21 Drawing Sheets

(56) References Cited

U.S. PATENT DOCUMENTS

| | | | |
|---|---|---|---|
| 6,550,953 | B1 | 4/2003 | Ichikawa et al. |
| 6,634,770 | B2 | 10/2003 | Cao |
| 6,659,632 | B2 | 12/2003 | Chen |
| 6,709,132 | B2 | 3/2004 | Ishibashi |
| 6,803,607 | B1 | 10/2004 | Chan et al. |
| 6,848,819 | B1 | 2/2005 | Arndt et al. |
| 6,864,513 | B2 | 3/2005 | Lin et al. |
| 6,948,829 | B2 | 9/2005 | Verdes et al. |
| 6,982,518 | B2 | 1/2006 | Chou et al. |
| 7,048,412 | B2 | 5/2006 | Martin et al. |
| 7,080,924 | B2 | 7/2006 | Tseng et al. |
| 7,086,756 | B2 | 8/2006 | Maxik |
| 7,086,767 | B2 | 8/2006 | Sidwell et al. |
| 7,144,135 | B2 | 12/2006 | Martin et al. |
| 7,165,866 | B2 | 1/2007 | Li |
| 7,172,314 | B2 | 2/2007 | Currie et al. |
| 7,213,940 | B1 | 5/2007 | Van De Ven et al. |
| 7,354,174 | B1 | 4/2008 | Yan |
| 7,396,142 | B2 | 7/2008 | Laizure, Jr. et al. |
| 7,600,882 | B1 | 10/2009 | Morejon et al. |
| 7,726,836 | B2 | 6/2010 | Chen |
| 7,824,065 | B2 | 11/2010 | Maxik |
| 7,965,023 | B1 | 6/2011 | Liang |
| 8,021,025 | B2 | 9/2011 | Lee |
| 8,253,316 | B2 | 8/2012 | Sun et al. |
| 8,272,762 | B2 | 9/2012 | Maxik et al. |
| 8,274,241 | B2 | 9/2012 | Guest et al. |
| 8,277,082 | B2 | 10/2012 | Dassanayake et al. |
| 8,282,249 | B2 | 10/2012 | Liang et al. |
| 8,282,250 | B1 | 10/2012 | Dassanayake et al. |
| 8,292,468 | B2 | 10/2012 | Narendran et al. |
| 8,322,896 | B2 | 12/2012 | Falicoff et al. |
| 8,371,722 | B2 | 2/2013 | Carroll |
| 8,400,051 | B2 | 3/2013 | Hakata et al. |
| 8,415,865 | B2 | 4/2013 | Liang et al. |
| 8,421,320 | B2 | 4/2013 | Chuang |
| 8,421,321 | B2 | 4/2013 | Chuang |
| 8,421,322 | B2 | 4/2013 | Carroll et al. |
| 8,427,037 | B2 | 4/2013 | Liang et al. |
| 8,449,154 | B2 | 5/2013 | Uemoto et al. |
| 8,502,468 | B2 | 8/2013 | Li et al. |
| 8,556,465 | B2 | 10/2013 | Lee et al. |
| 8,641,237 | B2 | 2/2014 | Chuang |
| 8,653,723 | B2 | 2/2014 | Cao et al. |
| 8,696,168 | B2 | 4/2014 | Li et al. |
| 8,740,415 | B2 | 6/2014 | Wheelock |
| 8,750,671 | B1 | 6/2014 | Kelly et al. |
| 8,752,984 | B2 | 6/2014 | Lenk et al. |
| 8,760,042 | B2 | 6/2014 | Sakai et al. |
| 2004/0201990 | A1 | 10/2004 | Meyer |
| 2009/0184618 | A1 | 7/2009 | Hakata et al. |
| 2011/0063842 | A1* | 3/2011 | Takei ..... F21V 19/004 362/249.01 |
| 2011/0273102 | A1 | 11/2011 | Van De Ven et al. |
| 2012/0040585 | A1 | 2/2012 | Huang |
| 2013/0026923 | A1 | 1/2013 | Athalye et al. |
| 2013/0026925 | A1 | 1/2013 | Ven et al. |
| 2013/0069535 | A1 | 3/2013 | Athalye |
| 2013/0069547 | A1 | 3/2013 | Van De Ven et al. |
| 2013/0162149 | A1 | 6/2013 | Van De Ven et al. |
| 2013/0162153 | A1 | 6/2013 | Van De Ven et al. |
| 2013/0169159 | A1 | 7/2013 | Lys |
| 2013/0170199 | A1 | 7/2013 | Athalye et al. |
| 2013/0293135 | A1 | 11/2013 | Hu et al. |
| 2014/0111984 | A1 | 4/2014 | Rodgers et al. |

FOREIGN PATENT DOCUMENTS

| | | | |
|---|---|---|---|
| GB | 2345954 | A | 7/2000 |
| JP | H09265807 | A | 10/1997 |
| JP | 2000173304 | A | 6/2000 |
| JP | 2001118403 | A | 4/2001 |
| JP | 2007059930 | A | 3/2007 |
| JP | 2008288183 | A | 11/2008 |
| JP | 2009117346 | A | 5/2009 |
| JP | 3153766 | U | 9/2009 |
| JP | 2009277586 | A | 11/2009 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |

* cited by examiner

LED LAMP WITH LED ASSEMBLY RETENTION MEMBER

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an enclosure for the electronics and or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is also often needed to cool the LEDs and/or power supply in order to maintain appropriate operating temperature.

SUMMARY OF THE INVENTION

In some embodiments, a lamp comprises an at least partially optically transmissive enclosure and a base. A LED assembly comprises at least one LED where the LED assembly is located in the enclosure and the at least one LED is operable to emit light when energized through an electrical path from the base. A heat sink comprises a heat conducting portion that is thermally coupled to the at least one LED assembly. The LED assembly is mounted on the heat conducting portion. A retention member is attached to the heat sink for restraining the LED assembly from moving relative to the heat conducting portion.

The LED assembly may be mounted on the heat conducting portion under radial tension. The LED assembly may be prevented from moving in an axial direction relative to the heat conducting portion. The retention member may comprise a cap that fits onto the heat conducting portion. The cap may include a seat that is inserted into a cavity in the heat conducting portion. The cap may include a flange that extends from the seat and that extends over a distal edge of the heat sink and a distal edge of the LED assembly. The flange may be configured to engage at least the distal edge of the LED assembly. The retention member may include a flange that extends over the distal edge of the LED assembly. The retention member may comprise an engagement member that fixes the retention member to the heat sink. The retention member may comprise a first engagement member that engages a mating second engagement member on the heat sink. One of the first engagement member and the second engagement member may comprise a deformable resilient finger. The finger may comprise a camming surface and a lock member. One of the first engagement member and the second engagement member may comprise a fixed member formed on the heat sink. The fixed member may support an electrical interconnect that provides an electrical connection between the LED assembly and the base. The first and second engagement members may form a snap-fit connection. The LED assembly may comprise a submount on which the at least one LED is mounted where the submount is engaged by the retention member. The submount may comprise at least one of a PCB, flex circuit, MCPCB, and lead frame. The submount may have a three-dimensional shape where a portion of the tower is positioned inside of the submount and the plurality of LEDs are mounted on an outside surface of the submount. The submount may comprise a flat member that is bent into a three-dimensional shape where the plurality of LEDs are mounted on an outside surface of the submount. The heat conducting portion may comprise a tower that extends along a longitudinal axis of the lamp and the LED assembly is mounted on the tower such that the at least one LED emits light laterally. A heat dissipating portion of the heat sink may be located between the enclosure and the base. The heat sink may be thermally coupled to the LED assembly for transmitting heat from the LED assembly to the ambient environment where the heat sink and the LED assembly are arranged such that the LED assembly is disposed substantially in the optical center of the enclosure. The at least one LED may comprise a plurality of LEDs positioned in a band such that a high intensity area of light produced from the plurality of LEDs appears as a glowing line of light when energized.

In some embodiments a method of making a lamp comprises providing an optically transmissive enclosure and a base; providing a heat sink comprising a heat conducting portion; mounting an LED assembly on the heat conducting portion under radial tension; mounting a retention member on the heat sink for restraining the LED assembly from moving in an axial direction relative to the heat conducting portion; securing the heat sink to the base; positioning the LED assembly in the optically transmissive enclosure; and securing the enclosure to the heat sink.

DETAILED DESCRIPTION

Figure 1:
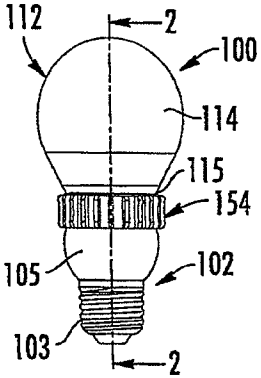
FIG. 1 is a front view of an embodiment of a LED lamp.
Figure 2:
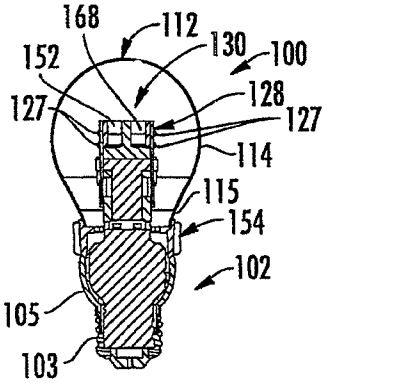
FIG. 2 is a section view taken along line 2-2 of FIG. 1.
Figure 3:
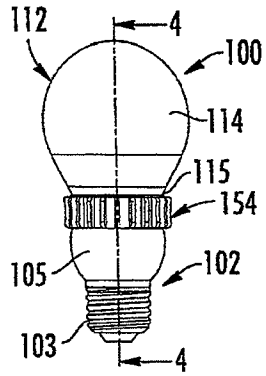
FIG. 3 is a side view of the lamp of FIG. 1.
Figure 4:
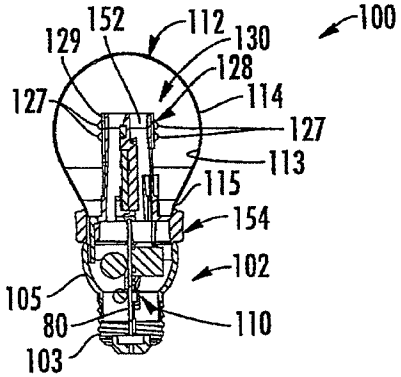
FIG. 4 is a section view taken along line 4-4 of FIG. 3.
Figure 5:
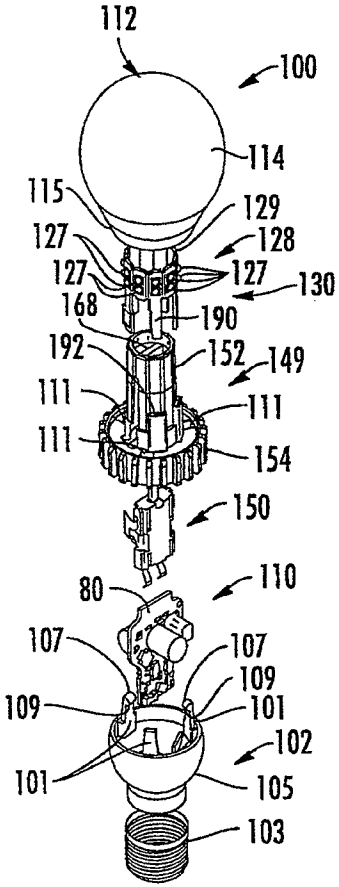
FIG. 5 is an exploded perspective view of the lamp of FIG. 1.
Figure 6:
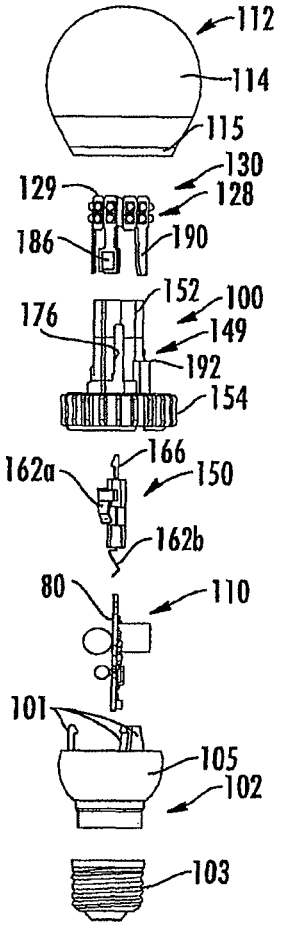
FIGS. 6 through 9 are exploded plan views of the lamp of FIG. 1 at different orientations of the lamp.
Figure 7:
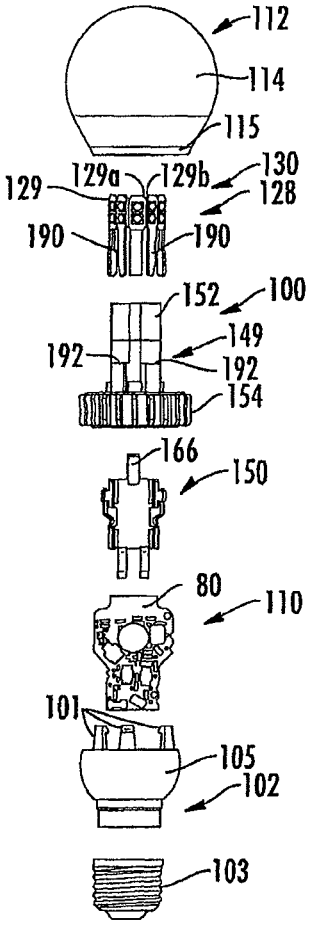
Figure 8:
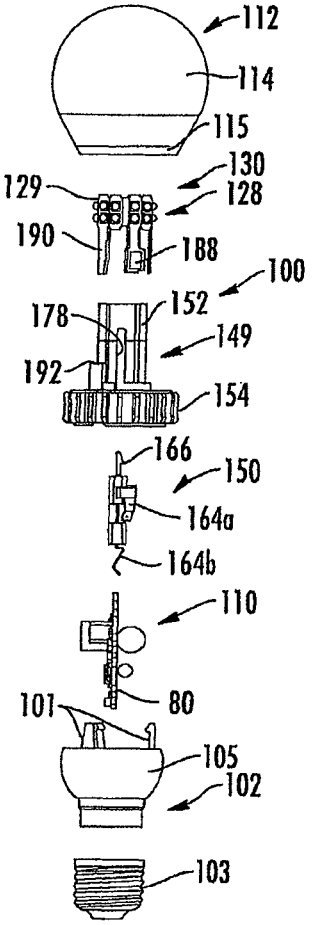
Figure 9:
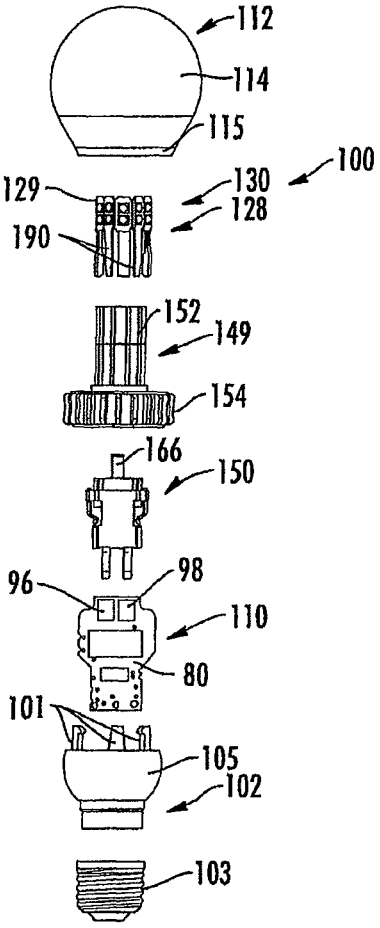
Figure 10:
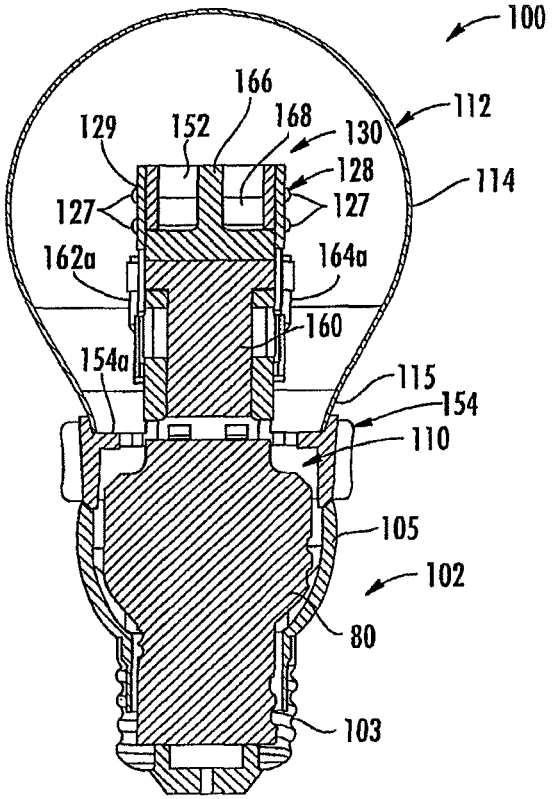
FIG. 10 is a section view similar to FIG. 2.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Embodiments of the present invention provide a solid-state lamp with centralized light emitters, more specifically, LEDs. Multiple LEDs can be used together, forming an LED array. The LEDs can be mounted on or fixed within the lamp in various ways. In at least some example embodiments, a submount is used. The LEDs are disposed at or near the central portion of the structural envelope of the lamp. Since the LED array may be configured in some embodiments to reside centrally within the structural envelope of the lamp, a lamp can be constructed so that the light pattern is not adversely affected by the presence of a heat sink and/or mounting hardware, or by having to locate the LEDs close to the base of the lamp. It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture.

FIGS. 1 through 11 show a solid-state lamp, 100 comprising a LED assembly 130 with light emitting LEDs 127. Multiple LEDs 127 can be used together, forming an LED array 128. The LEDs 127 in the LED array 128 may comprise an LED die disposed in an encapsulant such as silicone, and LEDs which are encapsulated with a phosphor to provide local wavelength conversion. A wide variety of LEDs and combinations of LEDs may be used in the LED assembly 130 as described herein. The LEDs 127 of the LED array 128 are operable to emit light when energized through an electrical path from base 102. The LEDs 127 are mounted on a submount 129 that may forms a part of the electrical path to the LEDs. In the present invention the term "submount" is used to refer to the support structure that supports the individual LEDs or LED packages and in one embodiment comprises a printed circuit board or "PCB" although it may comprise other structures such as a metal core PCB ("MCPCB"), lead frame extrusion, flex circuit or the like or combinations of such structures. An electrical path runs between the submount 129 and the lamp base 102 to carry both sides of the supply to provide critical current to the LEDs 127.

The LED assembly 130 may be contained in an optically transmissive enclosure 112 through which light emitted by the LEDs 127 is transmitted to the exterior of the lamp. In the embodiment of FIG. 1, for example, the enclosure 112 may be entirely optically transmissive where the entire enclosure 112 defines the exit surface through which light is emitted from the lamp. The enclosure 112 may have a traditional bulb shape having a globe shaped main portion 114 that narrows to a neck 115. In the embodiment of FIGS. 19-24 for example the enclosure 302 of directional lamp may be partially optically transmissive where the enclosure comprises an optically transmissive exit surface 308 and a reflective surface 310 for reflecting light to the exit surface. The enclosure 112, 302 may be made of glass, quartz, borosilicate, silicate, polycarbonate, other plastic or other suitable material. The enclosure may be of similar shape to that commonly used in standard BR and/or PAR incandescent bulbs (for example FIGS. 19-24) or to A series bulbs (for example FIGS. 1-11). In some embodiments, the exit surface of the enclosure may be coated on the inside with silica, providing a diffuse scattering layer that produces a more uniform far field pattern. The enclosure may also be etched, frosted or coated to provide the diffuser. In other embodiments the enclosure may be made of a material such as polycarbonate where the diffuser is created by the polycarbonate material. Alternatively, the surface treatment may be omitted and a clear enclosure may be provided. The enclosure may also be provided with a shatter proof or shatter resistant coating. It should also be noted that in this or any of the embodiments shown here, the optically transmissive enclosure or a portion of the optically transmissive enclosure could be coated or impregnated with phosphor or a diffuser.

Lamp 100 may be used as an A-series lamp with an Edison base 102, more particularly; lamp 100 is designed to serve as a solid-state replacement for an A19 incandescent bulb. In one embodiment, the enclosure and base are dimensioned to be a replacement for an ANSI standard A19 bulb such that the dimensions of the lamp 100 fall within the ANSI standards for an A19 bulb. The dimensions may be different for other ANSI standards including, but not limited to, A21 and A23 standards. While specific reference has been made with respect to an A-series lamp with an Edison base 102 the lamp may be embodied in other lamps such as a PAR-style lamp such as a replacement for a PAR incandescent bulb or a BR-style lamp. In other embodiments, the LED lamp can have any shape, including standard and non-standard shapes.

The base 102 comprises an electrically conductive Edison screw 103 for connecting to an Edison socket and a housing portion 105 connected to the Edison screw. The Edison screw 103 may be connected to the housing portion 105 by adhesive, mechanical connector, welding, separate fasteners or the like. The housing portion 105 and the Edison screw 103 define an internal cavity for receiving the lamp electronics 110 including the power supply and/or drivers or a portion of the electronics for the lamp. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110. The lamp electronics 110 include a first contact pad 96 and a second contact pad 98 (FIGS. 9 and 19) that allow the lamp electronics 110 to be electrically coupled to the LED assembly 130 in the lamp as will hereinafter be described. Contact pads 96 and 98 may be formed on printed circuit board 80 which includes the power supply, including large capacitor and EMI components that are across the input AC line, along with the driver circuitry as described herein.

In some embodiments, a driver and/or power supply are included with the LED array 128 on the submount 129. In other embodiments the lamp electronics 110 such as the driver and/or power supply are included in the base 102 as shown and other components may be mounted on PCB 80. The power supply and drivers may also be mounted separately where components of the power supply are mounted in the base 102 and the driver is mounted with the submount 129 in the enclosure 112. Base 102 may include a power supply or driver and form all or a portion of the electrical path between the mains and the LEDs 127. The base 102 may also include only part of the power supply circuitry while some smaller components reside on the submount 129. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Other embodiments are possible using different driver configurations, or a boost supply at lower voltages.

The LED assembly 130 comprises a submount 129 arranged such that the LED array 128 is substantially in the center of the enclosure 112 such that the LEDs 127 are positioned at the approximate center of enclosure 112. As used herein the term "center of the enclosure" refers to the vertical position of the LEDs in the enclosure as being aligned with the approximate largest diameter area of the globe shaped main body 114. "Vertical" as used herein means along the longitudinal axis of the bulb where the longitudinal axis extends from the base to the free end of the bulb as represented for example by the dashed section line 2-2 in FIG. 1. In one embodiment, the LED array 128 is arranged in the approximate location that the visible glowing filament is disposed in a standard incandescent bulb. The terms "center of the enclosure" does not necessarily mean the exact center of the enclosure and is used to mean that the LEDs are located along the longitudinal axis of the lamp at a position between the ends of the enclosure 112 near a central portion of the enclosure.

Figure 16:
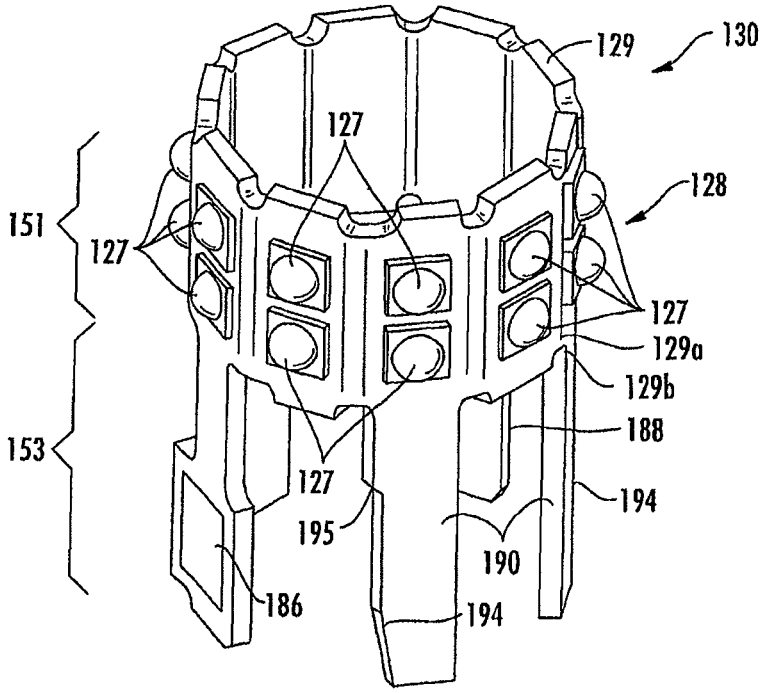
FIG. 16 is a perspective view of the LED assembly of FIG. 1.
Figure 17:
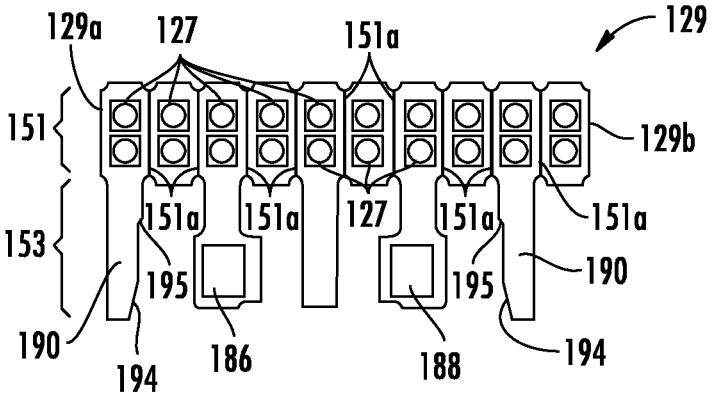
FIG. 17 is a side view of an embodiment of a MCPCB submount usable in embodiments of the lamp of the invention.
Figure 18:
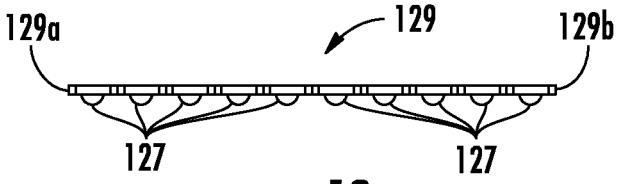
FIG. 18 is an end view of the embodiment of a MCPCB submount of FIG. 19.
Figures 19, 20, 21, 22, 23:
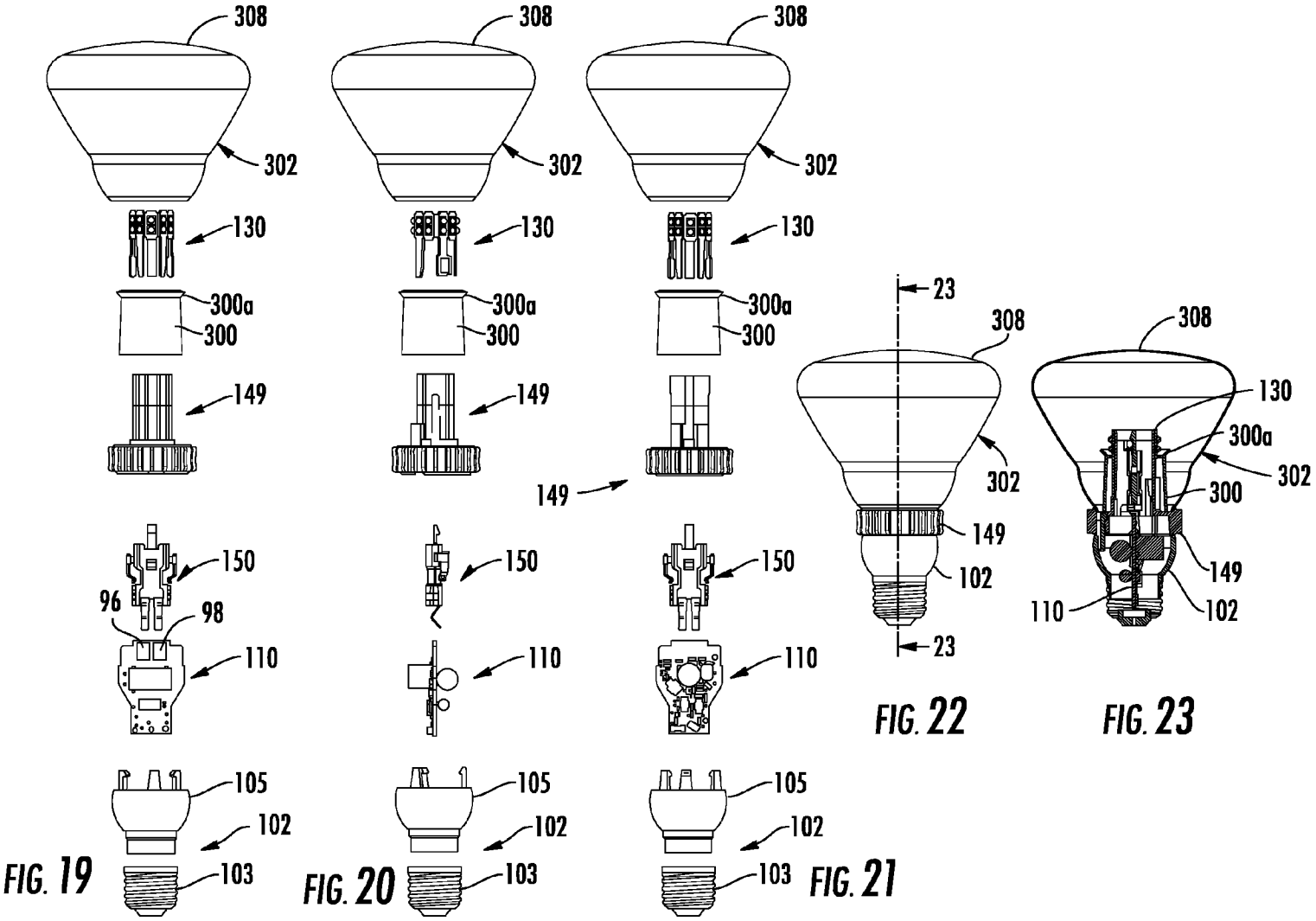
FIGS. 19 through 21 are exploded plan views of an alternate embodiment of an LED lamp at different orientations of the lamp.
FIG. 22 is a front view of the embodiment of the lamp of FIG. 19.
FIG. 23 is a section view taken along line 23-23 of FIG. 22.
Figure 24:
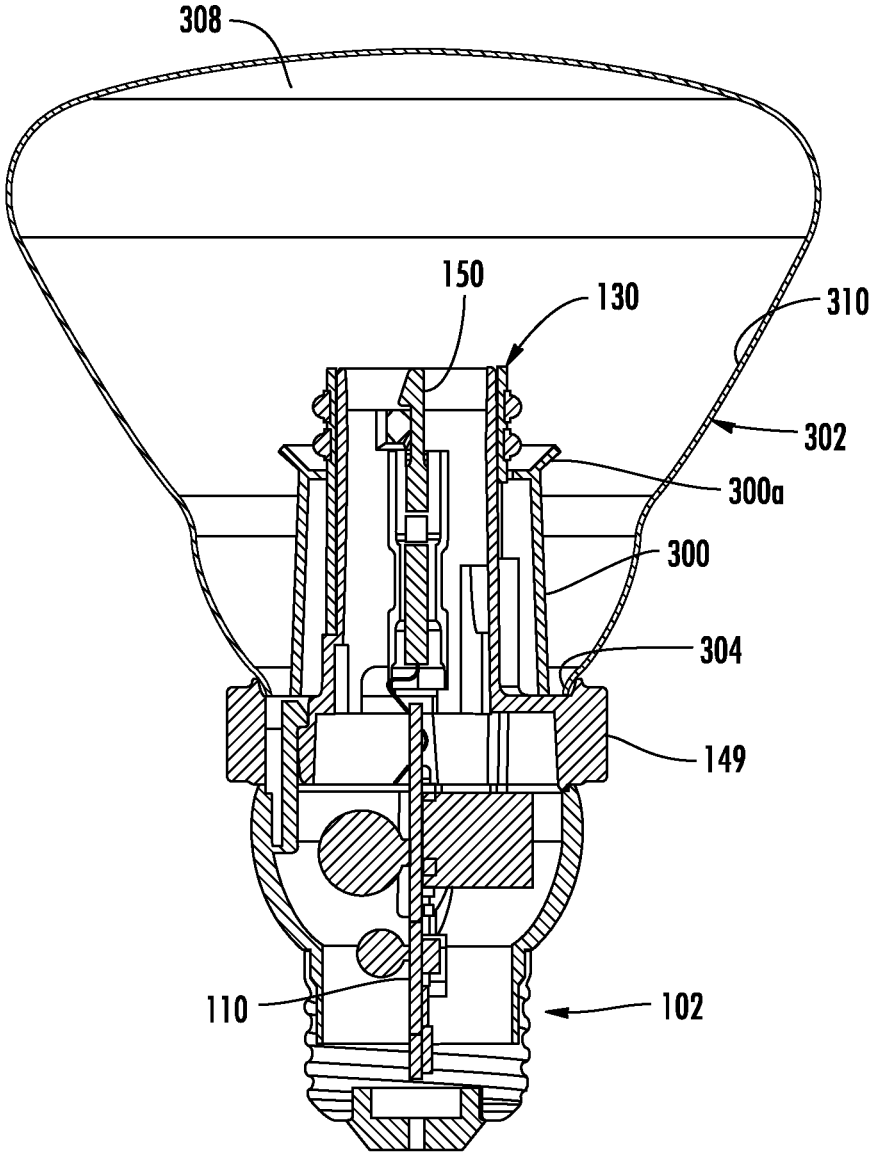
FIG. 24 is a more detailed section view taken along line 23-23 of FIG. 22.

Referring to FIGS. 16, 17 and 18, in some embodiments, the submount 129 may comprise a PCB, MCPCB, flex circuit or other similar structure. The submount may be made of or comprise a thermally conductive material. The submount 129 comprises a first LED mounting portion 151 that functions to mechanically and electrically support the LEDs 127 and a second connector portion 153 that functions to provide thermal, electrical and mechanical connections to the LED assembly 130. Extensions 190, as shown for example in FIG. 16, may be formed on the LED assembly that connect the LED assembly 130 to the heat sink 149 and that position and support the LEDs 127 in the proper position in the enclosure.

The submount may comprise a series of anodes and cathodes arranged in pairs for connection to the LEDs 127. In the illustrated embodiment 20 pairs of anodes and cathodes are shown for an LED assembly having 20 LEDs 127; however, a greater or fewer number of anode/cathode pairs and LEDs may be used. Moreover, more than one submount may be used to make a single LED assembly 130. Electrical connectors or conductors such as traces connect the anode from one pair to the cathode of the adjacent pair to provide the electrical path between the anode/cathode pairs during operation of the LED assembly 130. An LED or LED package containing at least one LED 127 is secured to each anode and cathode pair where the LED/LED package spans the anode and cathode. The LEDs/LED packages may be attached to the submount by soldering. In one embodiment, the exposed surfaces of the submount 129 may be coated with silver, white plastic or other reflective material to reflect light inside of enclosure 112 during operation of the lamp. The submount 129 may have a variety of shapes, sizes and configurations.

In some embodiments, the submount 129 of the LED assembly 130 may comprise a lead frame made of an electrically conductive material such as copper, copper alloy, aluminum, steel, gold, silver, alloys of such metals, thermally conductive plastic or the like. In another embodiment of LED assembly 130 the submount 129 may comprise a metal core board such as a metal core printed circuit board (MCPCB) as shown, for example, in FIGS. 16, 17 and 18. The metal core board comprises a thermally and electrically conductive core made of aluminum or other similar pliable metal material. The core is covered by a dielectric material such as polyimide. Metal core boards allow traces to be formed therein. In one method, the submount 129 is formed as a flat member and is bent into a suitable shape such as a cylinder, sphere, polyhedra or the like.

In one embodiment the core board is formed as a flat member having a first LED mounting portion 151 on which the LEDs/LED packages containing LEDs 127 are mounted. The first portion 151 may be divided into sections by thinned areas or score lines 151*a*. The LEDs/LED packages are located on the sections such that the core board may be bent along the score lines to form the planar core board into a variety of three-dimensional shapes where the shape is selected to project a desired light pattern from the lamp 100.

In another embodiment of the LED assembly 130 the submount 129 comprises a hybrid of a metal core board and lead frame. The metal core board may form the LED mounting portion 151 on which the LED packages containing LEDs 127 are mounted where the back side of the metal core board may be mechanically coupled to a lead frame structure. The lead frame structure may form the connector portion 153. Both the lead frame and the metal core board may be bent into the various configurations as discussed herein.

The LED assembly may also comprise a PCB made with FR4 and thermal vias rather than the MCPCB where the thermal vias are then connected to the lead frame structure. A PCB FR4 board comprises a thin layer of copper foil laminated to one side, or both sides, of an FR4 glass epoxy panel. The FR4 copper-clad sheets comprise circuitry etched into copper layers to make the PCB FR4 board.

In another embodiment of LED assembly 130 the submount 129 may comprise a flex circuit that is mounted on the heat sink. A flex circuit may comprise a flexible layer of a dielectric material such as a polyimide, polyester or other material to which a layer of copper or other electrically conductive material is applied such as by adhesive. Electrical traces are formed in the copper layer to form electrical pads for mounting the electrical components such as LEDs 127 on the flex circuit and for creating the electrical path between the components.

The submount 129 may be bent or folded or otherwise formed such that the LEDs 127 provide the desired light pattern in lamp 100. In a lead frame configuration, the lead frame may be bent at the connectors, in a metal core board configuration the core board may be bent at thinned score to form the three-dimensional LED assembly 130 and in a flex circuit the entire circuit may be flexible and bendable. In one embodiment the submount 129 is bent or otherwise formed to have a generally cylindrical shape as shown in the figures. The LEDs 127 are disposed about the axis of the cylinder such that light is projected outward. The LEDs 127 may be arranged around the perimeter of the LED assembly to project light radially.

The angles of the LEDs and the number of LEDs may be varied to create a desired light pattern. For example, the figures show an embodiment of a two tiered LED assembly 130 where each tier comprises a series of a plurality of LEDs 127 arranged around the perimeter of the cylinder. While a two tiered LED assembly is shown the LED assembly may comprise one tier, three tiers or additional tiers of LEDs where each tier comprises a series of a plurality of LEDs 127 arranged around the perimeter of the cylinder. In the illustrated embodiments the submount 129 is formed to have a generally cylindrical shape; however, the submount may have other shapes The LED assembly 130 may be advantageously bent or formed into any suitable three-dimensional shape. A "three-dimensional" LED assembly as used herein and as shown in the drawings means an LED assembly where the submount comprises mounting surfaces for different ones of the LEDs that are in different planes such that the LEDs mounted on those mounting surfaces are also oriented in different planes. In some embodiments the planes are arranged such that the LEDs are disposed over a 360 degree range.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light. Such embodiments can produce light with a CRI of at least 70, at least 80, at least 90, or at least 95. By use of the term substantially white light, one could be referring to a chromacity diagram including a blackbody 160 locus of points, where the point for the source falls within four, six or ten MacAdam ellipses of any point in the blackbody 160 locus of points.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

Figure 12:
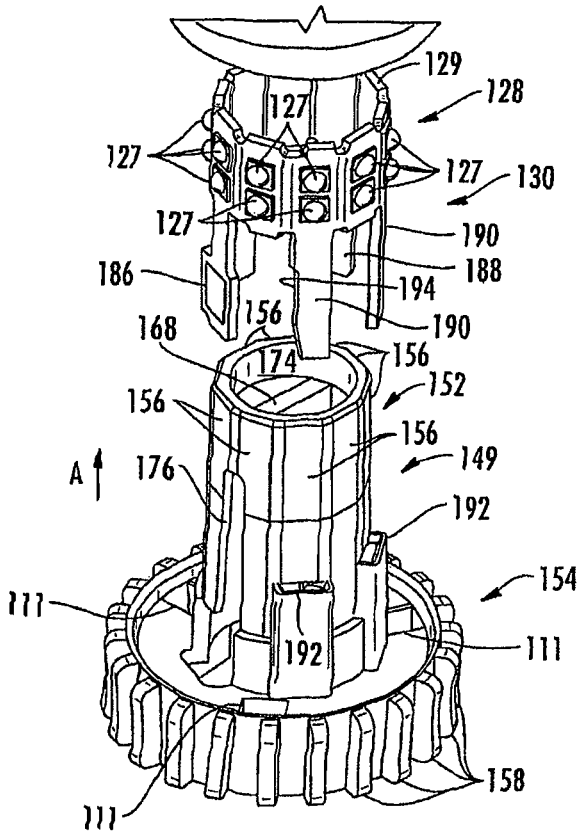
FIG. 12 is an exploded view showing an embodiment of the heat sink and LED assembly of FIG. 1.
Figure 15:
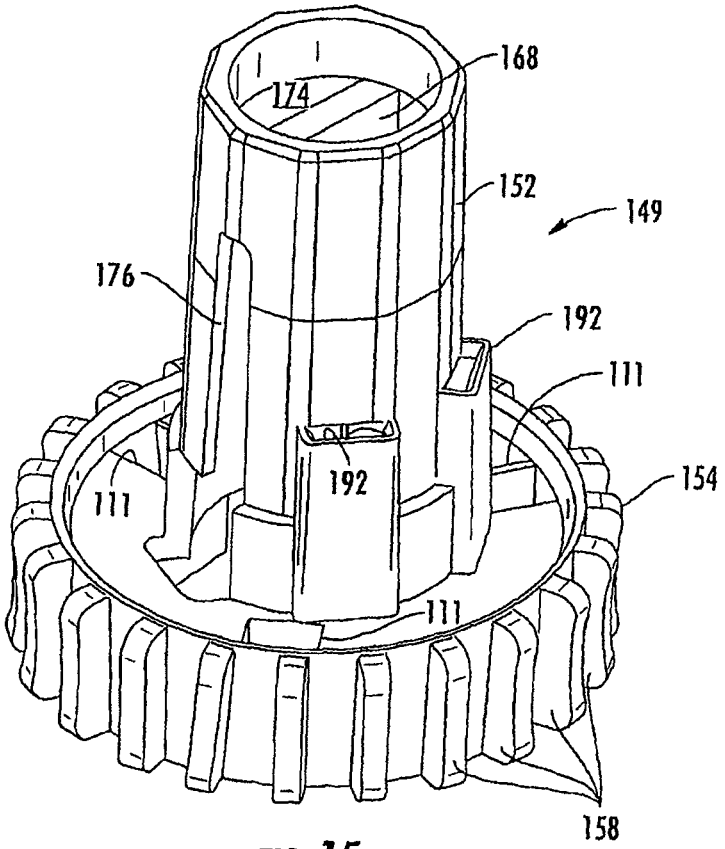
FIG. 15 is a perspective view of the heat sink of FIG. 1.

Referring again to the figures, the LED assembly 130 may be mounted to the heat sink structure 149 by an electrical interconnect 150 that provides the electrical connection between the LED assembly 130 and the lamp electronics 110. The heat sink structure 149 comprises a heat conducting portion or tower 152 and a heat dissipating portion 154 as shown for example in FIGS. 12 and 15. In one embodiment the heat sink 149 is made as a one-piece member of a thermally conductive material such as aluminum, zinc or the like. The heat sink structure 149 may also be made of multiple components secured together to form the heat structure. Moreover, the heat sink 149 may be made of any thermally conductive material or combinations of thermally conductive materials.

The heat conducting portion 152 is formed as a tower that is dimensioned and configured to make good thermal contact with the LED assembly 130 such that heat generated by the LED assembly 130 may be efficiently transferred to the heat sink 149. In one embodiment, the heat conducting portion 152 comprises a tower that extends along the longitudinal axis of the lamp and extends into the center of the enclosure 112. The heat conducting portion 152 may comprise generally cylindrical outer surface that matches the generally cylindrical internal surface of the LED assembly 130. In the illustrated embodiment the portions of the substrate 129 on which the LEDs 127 are mounted are generally planar. As a result, while the LED assembly 130 is generally cylindrical, the cylinder is comprised of a plurality of planar segments. In one embodiment the heat conducting portion 152 is formed with a plurality of planar facets 156 that abut the planar portions of the submount 129 to provide good surface to surface contact. While the LED assembly 130 and the heat conducting portion 152 are shown as being generally cylindrical these components may have any configuration provided good thermal conductivity is created between the LED assembly 130 and the heat conducting portion 152.

The heat dissipating portion 154 is in good thermal contact with the heat conducting portion 152 such that heat conducted away from the LED assembly 130 by the heat conducting portion 152 may be efficiently dissipated from the lamp 100 by the heat dissipating portion 154. In one embodiment the heat conducting portion 152 and heat dissipating portion 154 are formed as one-piece. The heat dissipating portion 154 extends from the interior of the enclosure 112 to the exterior of the lamp 100 such that heat may be dissipated from the lamp to the ambient environment. In one embodiment the heat dissipating portion 154 is formed generally as a disk where the distal edge of the heat dissipating portion 154 extends outside of the lamp and forms an annular ring that sits on top of the open end of the base 102. A plurality of heat dissipating members 158 may be formed on the exposed portion to facilitate the heat transfer to the ambient environment. In one embodiment, the heat dissipating members 158 comprise a plurality fins that extend outwardly to increase the surface area of the heat dissipating portion 154. The heat dissipating portion 154 and fins 158 may have any suitable shape and configuration.

Figure 13:
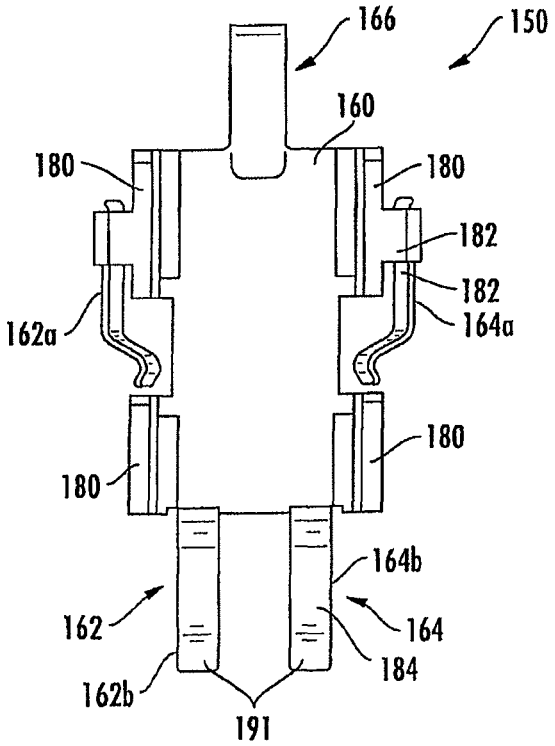
FIG. 13 is a plan view showing an embodiment of the electrical interconnect of FIG. 1.
Figure 14:
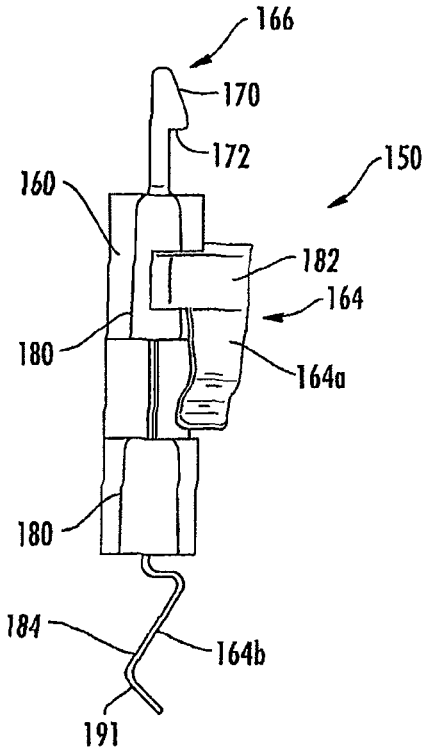
FIG. 14 is a side view showing an embodiment of the electrical interconnect of FIG. 1.

The electrical interconnect 150 provides the electrical conductors to connect the LED assembly 130 to the lamp electronics 110 and is shown in FIGS. 13 and 14. The interconnect 150 provides an electrical connection between the LED assembly 130 and the lamp electronics 110 that does not require bonding of the contacts from the lamp electronics 110 to the LED assembly 130.

As shown in the figures, the electrical interconnect 150 comprises a body 160 that includes a first conductor 162 for connecting to one of the anode or cathode side of the LED assembly 130 and a second conductor 164 for connecting to the other one of the anode or cathode side of the LED assembly 130. The first conductor 162 extends through the body 160 to form an LED-side contact 162*a* and a lamp electronics-side contact 162*b*. The second conductor 164 extends through the body 160 to form an LED-side contact 164*a* and a lamp electronics-side contact 164*b*. The body 160 may be formed by insert molding the conductors 162, 164 in a plastic insulator body 160. While the electrical interconnect 150 may be made by insert molding the body 160, the electrical interconnect 150 may be constructed in a variety of manners. For example, the body 160 may be made of two sections that are joined together to trap the conductors 162, 164 between the two body sections. Further, each conductor may be made of more than one component provided an electrical pathway is provided in the body 160.

A support and/or alignment mechanism is configured to position the first and/or second set of contacts relative to the corresponding electrical contacts of the LED assembly and lamp electronic. The support and/or alignment mechanism may comprise a first engagement member 166 on body 160 that engages a mating second engagement member 168 on the heat sink 149. In one embodiment the first engagement member 166 comprises a deformable resilient finger that comprises a camming surface 170 and a lock member 172. The second engagement member 168 comprises a fixed member located in the internal cavity 174 of the heat sink 149. The electrical interconnect 150 may be inserted into the cavity 174 from the bottom of the heat sink 149 and moved toward the opposite end of the heat sink such that the camming surface 170 contacts the fixed member 168. The engagement of the camming surface 170 with the fixed member 168 deforms the finger 166 to allow the lock member 172 to move past the fixed member 168. As the lock member 172 passes the fixed member 168 the finger 166 returns toward its undeformed state such that the lock member 172 is disposed behind the fixed member 168. The engagement of the lock member 172 with the fixed member 168 fixes the electrical interconnect 150 in position in the heat sink 149. The snap-fit connection allows the electrical interconnect 150 to be inserted into and fixed in the heat sink 149 in a simple insertion operation without the need for any additional connection mechanisms, tools or assembly steps. While one embodiment of the snap-fit connection is shown, numerous changes may be made. For example, the deformable resilient member may be formed on the heat sink 149 and the fixed member 168 may be formed on the electrical interconnect 150. Moreover, both the first and the second engagement members may be deformable and more than one of each engagement member may be used. Further, rather than using a snap-fit connection, the electrical interconnect 150 may be fixed to the heat sink using other connection mechanisms such as a bayonet connection, screwthreads, friction fit or the like that also do not require additional connection mechanisms, tools or assembly steps.

The support and/or alignment arrangement may properly orient the electrical interconnect 150 in the heat sink 149 and provide a passage for the LED-side contacts 162*a*, 164*a*, and may comprise a first slot 176 and a second slot 178 formed in the heat conducting portion 152. The first slot 176 and the second slot 178 may be arranged opposite to one another and receive ears or tabs 180 that extend from the body 160. The tabs 180 are positioned in the slots 176, 178 such that as the electrical interconnect 150 is inserted into the heat sink 149, the tabs 180 engage the slots 176, 178 to guide the electrical interconnect 150 into the heat sink 149. The tabs 180 and slots 176, 178 may be formed with mating trapezoidal shapes such that as the tabs 180 are inserted into the slots 176, 178 the mating narrowing sides properly align the electrical interconnect 150 in the heat sink 149

The first LED-side contact 162*a* and the second LED-side contact 164*a* are arranged such that the contacts extend through the first and second slots 176, 178, respectively, as the electrical interconnect 150 is inserted into the heat sink 149. The contacts 162*a*, 164*a* are exposed on the outside of the heat conducting portion 152. The contacts 162*a*, 164*a* are arranged such that they create an electrical connection to the anode side and the cathode side of the LED assembly 130 when the LED assembly 130 is mounted on the heat sink 149. In the illustrated embodiment the contacts are identical such that specific reference will be made to contact 164*a*. The contact 164*a* comprises a laterally extending portion 182 that extends from the body 160 and that extends through the slot 178. The laterally extending portion 182 connects to a spring portion 182 that is arranged such that it extends over the heat conducting portion 152 and abuts or is in close proximity to the outer surface of the heat conducting portion 152. The contact 164*a* is resilient such that it can be deformed to ensure a good electrical contact with the LED assembly 130 as will be described.

The first electronic-side contact 162*b* and the second electronic-side contact 164*b* are arranged such that the contacts 162*b*, 164*b* extend beyond the bottom of the heat sink 149 when the electrical interconnect 150 is inserted into the heat sink 149. The contacts 162*b*, 164*b* are arranged such that they create an electrical connection to the anode side and the cathode side of the lamp electronics 110. In the illustrated embodiment the contacts 162*b*, 164*b* are identical such that specific reference will be made to contact 164*b*. The contact 164*b* comprises a spring portion 184 that is arranged such that it extends generally away from the electrical interconnect 150. The contact 164*b* is resilient such that it can be deformed to ensure a good electrical contact with the lamp electronics 110 as will be described.

To mount the LED assembly 130 on the heat sink 149 the heat conducting portion 152 of heat sink 149 is inserted into the LED assembly 130 such that the LED assembly 130 surrounds and contacts the heat conducting portion 152. The LED assembly 130 comprises an anode side contact 186 and a cathode side contact 188. The contacts 186, 188 may be formed as part of the conductive submount 129 on which the LEDs are mounted. For example, the contacts 186, 188 may be formed as part of the PCB, lead frame or MCPCB or other submount 129. The contacts 186, 188 are electrically coupled to the LEDs 127 such that they form part of the electrical path between the lamp electronics 110 and the LED assembly 130. The contacts 186, 188 extend from the LED mounting portion 151 such that when the LED assembly 130 is mounted on the heat sink 149 the contacts 186, 188 are disposed between the LED-side contacts 162*a*, 164*a*, respectively, and the heat sink 149. The LED-side contacts 162*a*, 164*a* are arranged such that as the contacts 186, 188 are inserted behind the LED-side contacts 162*a*, 164*a*, the LED-side contacts 162*a*, 164*a* are slightly deformed. Because the LED-side contacts 162*a*, 164*a* are resilient, a bias force is created that biases the LED-side contacts 162*a*, 164*a* into engagement with the LED assembly 130 contacts 186, 188 to ensure a good electrical coupling between the LED-side contacts 162*a*, 164*a* and the LED assembly 130. The engagement between the LED-side contacts of the electrical interconnect 150 and the and the anode side contact and the cathode side contact of the LED assembly 130 is referred to herein as a contact coupling where the electrical coupling is created by the contact under pressure between the contacts as distinguished from a soldered coupling.

To position the LED assembly 130 relative to the heat sink and to fix the LED assembly 130 to the heat sink, a pair of extensions 190 are provided on the LED assembly 130 that engage mating receptacles 192 formed on the heat sink. In one embodiment the extensions 190 comprise portions of the submount 129 that extend away from the LED mounting area 151 of the LED assembly 130. The extensions 190 extend toward the bottom of the heat sink 149 along the direction of insertion of the LED assembly 130 onto the heat sink. The heat sink 149 is formed with mating receptacles 192 that are dimensioned and arranged such that one of the extensions 190 is inserted into each of the receptacles 192 when the heat sink 149 is inserted into the LED assembly 130. The engagement of the extensions 190 and the receptacles 192 properly positions the LED assembly 130 relative to the heat sink during assembly of the lamp.

Moreover, to fix the LED assembly 130 on the heat sink 149 and to seat the LED assembly 130 against the heat conducting portion 152 to ensure good thermal conductivity between these elements, the extensions 190 are formed with camming surfaces 194 that engage the receptacles 192 and clamp the LED assembly 130 on the heat sink 149. The engagement of the extensions 190 with the receptacles 192 is used to hold the LED assembly 130 in the desired shape and to clamp the LED assembly 130 on the heat sink. As shown in FIG. 16 a surface of each of the extensions 190 is formed as a camming surface 194 where the camming surface 194 is created by arranging the surface 194 an angle relative to the insertion direction of the LED assembly 130 on the heat sink 149, or as a stepped surface, or as a curved surface or as a combination of such surfaces. As a result, as each extension 190 is inserted into the corresponding receptacle 192 the wall of the receptacle 192 engages the camming surface 194 and, due to the angle or shape of the camming surface 194, exerts a force on the LED assembly 130 tending to move one free end 129*a* of the LED assembly 130 toward the opposite free end 129*b* of the LED assembly 130. The extensions 190 are formed at or near the free ends of the LED assembly 130 and the camming surfaces 194 are arranged such that the free ends 129*a*, 129*b* of the LED assembly 130 are moved in opposite directions toward one another. As the free ends of the LED assembly 130 are moved toward one another, the inner circumference of the LED assembly 130 is gradually reduced such that the LED assembly 130 exerts an increasing clamping force on the heat conducting portion 152 as the LED assembly 130 is inserted on the heat sink 149. The camming surfaces 194 are arranged such that when the LED assembly 130 is completely seated on the heat sink 149 the LED assembly 130 exerts a tight clamping force on the heat conducting portion 152. The clamping force holds the LED assembly 130 on the heat sink 149 and ensures a tight surface-to-surface engagement between the LED assembly 130 and the heat sink 149 such that heat generated by the LED assembly 130 is efficiently transferred to the heat sink 149. The LED submount 129 is under radial tension on the heat sink 149. The extensions 190 may be provided with a stop such as shoulder 195 that abuts the edge of the receptacles 192 to limit the insertion of the extensions 190 into the receptacles 192. The LED assembly 130 is held on the heat sink by the wedging action of the extensions 190 in the receptacles 192 as well as the clamping force exerted by the LED assembly 130 on the heat conducting portion 152.

While a specific arrangement of the camming surfaces 194 and receptacles 192 is shown, the camming surfaces 194 may be formed on either or both of the heat sink 149 and LED assembly 130. The camming surfaces and the surfaces that are engaged by the camming surfaces may have a variety of structures and forms. Moreover, one free end of the substrate may be held stationary while the opposite end is moved toward the stationary end.

When the electrical interconnect 150 is mounted to the heat sink 149 and the LED assembly 130 is mounted on the heat sink 149, an electrical path is created between the electronics-side contacts 162*a*, 164*a* of the electrical interconnect 150 and the LED assembly 130. These components are physically and electrically connected to one another and the electrical path is created without using any additional fasteners, connection devices, tools or additional assembly steps. The electrical interconnect 150 is simply inserted into the heat sink 149 and the heat sink 149 is simply inserted into the LED assembly 130.

FIGS. 19-24 show an embodiment of a lamp that uses the LED assembly 130, heat sink with the tower arrangement 149, and electrical interconnect 150 as previously described in a BR and PAR type lamp. The previous embodiments of a lamp refer more specifically to an omnidirectional lamp such as an A19 replacement bulb. In the BR or PAR lamp shown in FIGS. 19-24 the light is emitted in a directional pattern rather than in an omnidirectional pattern. The lamp shown in FIGS. 19-24 may be used as a solid state replacement for such BR, PAR or reflector type bulbs or other similar bulbs.

As previously explained, the LED assembly 130 generates an omnidirectional light pattern. To create a directional light pattern, a primary reflector 300 is provided that reflects light generated by the LED assembly 130 generally in a direction along the axis of the lamp. Where the lamp is intended to be used as a replacement for a BR type lamp the reflector 300 may reflect the light in a generally wide beam angle and may have a beam angle of up to approximately 90-100 degrees. As a result, the reflector 300 may have a reflective surface 300*a* that comprises a variety of shapes and sizes provided that light reflecting off of the reflector 300 is reflected generally along the axis of the lamp. The reflector 300 may, for example, be conical, parabolic, hemispherical, faceted or the like. Where the lamp is intended to be used as a replacement for a PAR type lamp, the reflector 300 may reflect the light in a tightly controlled beam angle. The reflector 300 may comprise a parabolic reflective surface 300*a* such that light reflecting off of the reflector 300 is reflected generally along the axis of the lamp to create a beam with a controlled beam angle.

In some embodiments, the reflector may be a diffuse or Lambertian reflector and may be made of a white highly reflective material such as injection molded plastic, white optics, PET, MCPET, or other reflective materials. The reflector may reflect light but also allow some light to pass through it. The reflector 300 may be made of a specular material. The specular reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. It could also be formed aluminum, or a flower petal arrangement in aluminum using Alanod's Miro or Miro Silver sheet.

Figure 25:
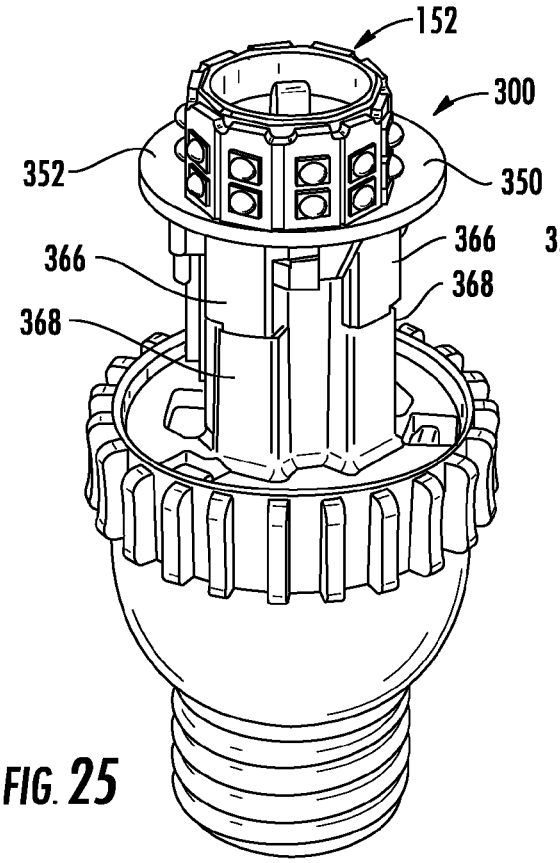
FIG. 25 is a perspective view of an embodiment of a reflector, heat sink and base.
Figure 26:
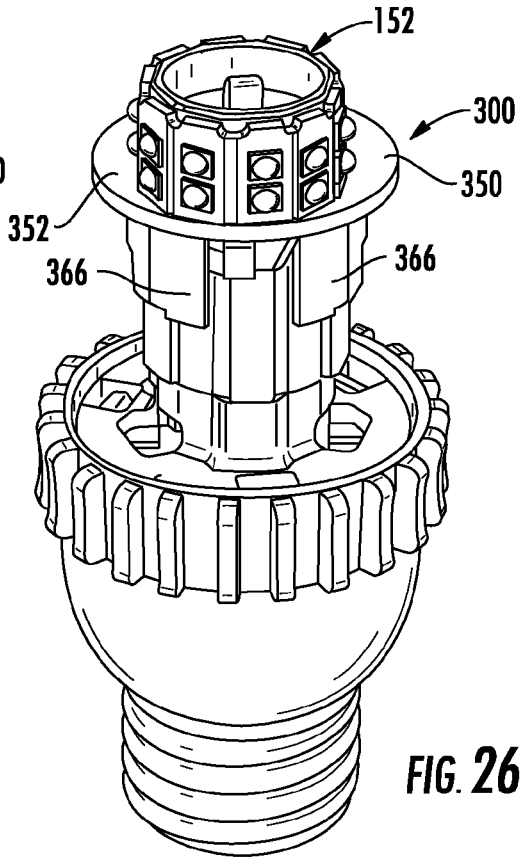
FIG. 26 is a perspective view of the embodiment of the reflector of FIG. 25, heat sink and base in a different orientation.
Figure 27:
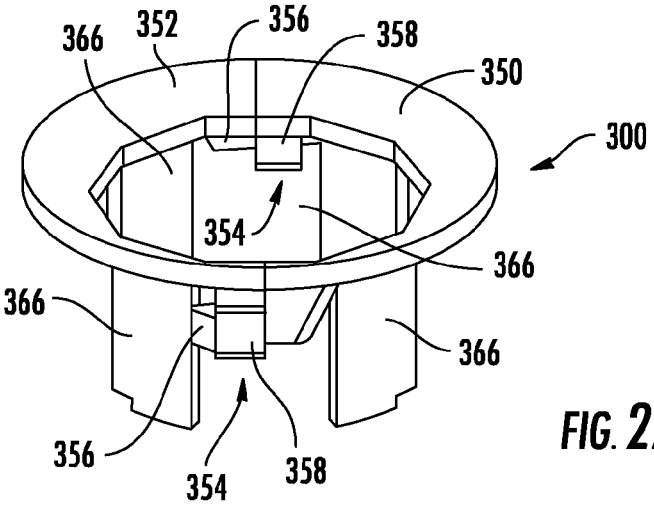
FIG. 27 is a perspective view of the reflector of FIG. 25.
Figure 28:
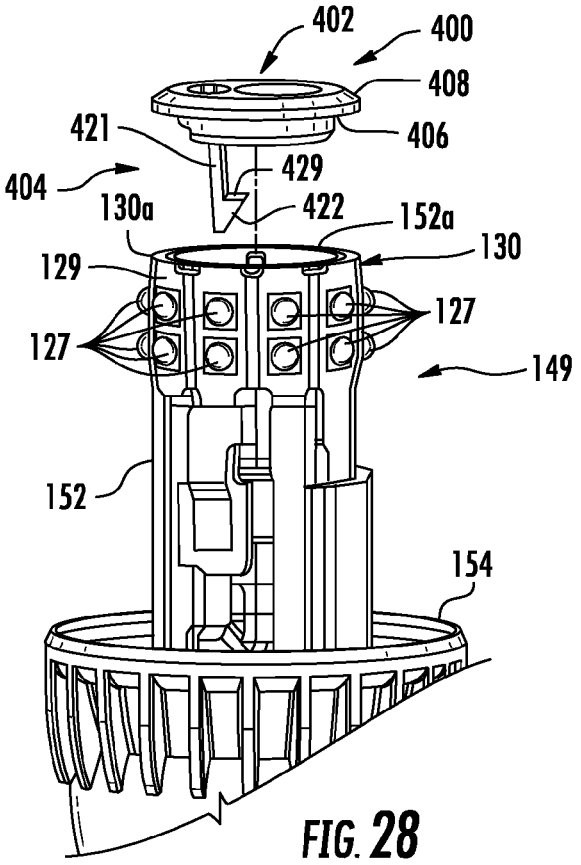
FIG. 28 is a detailed exploded perspective view of an embodiment of the retention member of the invention and a portion of the heat sink.

The reflector 300 is mounted in the lamp such that it surrounds the LED assembly 130 and reflects some of the light generated by the LED assembly. In one embodiment, the reflector 300 is made in two portions 350 and 352 that together surround the heat conducting portion or tower 152 and connect to one another using snap fit connectors 354 to clamp the heat sink therebetween as shown in FIGS. 25-27. The snap fit connectors 354 may comprise a deformable tang 356 on one reflector portion that is received in a mating receptacle 358 on the other reflector portion where each reflector portion comprises one tang and one receptacle. However, two tangs may be formed on one portion and two receptacles may be formed on the other portion. The tangs 356 may be inserted into the receptacles 358 such that locking surfaces on the tangs 356 are disposed behind the receptacles 358. The tangs and/or receptacles may be made of resilient material to allow these components to deflect as the tangs 356 are inserted into the receptacles 358. The two portions 350 and 352 may be brought into engagement with one another with the heat sink 152 trapped between the portions. The reflector 300 may comprise legs 366 that are supported on protrusions 368 formed on the heat sink 152 to properly vertically position the reflector 300 on the heat sink 152 and to maintain the reflector in the proper orientation relative to the LEDs. The reflector 300 may also include protrusions that extend toward the interior of the reflector and that engage the heat sink structure to fix the angular relationship between the reflector and heat sink such that the reflector is prevented from rotating relative to the heat sink. The reflector 300 may also be mounted to the heat sink 149 or LED assembly 130 using separate fasteners, adhesive, friction fit, mechanical engagement such as a snap-fit connection, welding or the like. The structure of the reflector described above may be used with any of the embodiments of the reflector and in any of the lamps described herein.

The reflector 300 is dimensioned such that the LED assembly 130, heat sink 149 and reflector 300 may be inserted through the opening 304 in the neck of enclosure 302. The LED assembly 130, heat sink 149 and reflector 300 are inserted into the enclosure 302. The enclosure 302 may be secured to the heat sink 149 as previously described using adhesive or other connection mechanism. The enclosure 302 may be coated on an interior surface with a highly reflective material such as aluminum to create a reflective surface 310 and an exit surface 308 through which the light exits the lamp. The exit surface 308 may be frosted or otherwise treated with a light diffuser material. Moreover, the reflector 300 may be mounted to the enclosure 302 rather than to the LED assembly and/or heat sink.

As previously explained, the reflector 300 may be positioned such that it reflects some of the light generated by the LED assembly 130. However, at least a portion of the light generated by the LED assembly 130 may not be reflected by the reflector 300. At least some of this light may be reflected by the reflective surface 310 of the enclosure 302. Some of the light generated by the LED assembly 130 may also be projected directly out of the exit surface 308 without being reflected by the primary reflector 300 or the reflective surface 310.

The exit surface 308 may include surface texturing. This surface texturing provides additional diffusion for light exiting the light engine. This surface texture may comprise dimpling, frosting, or any other type of texture that can be applied to a lens for a lighting system. While the exit surface 308 is slightly curved, the exit surface may comprise a flat exit surface, or a curved entry service.

The exit surface 308 according to example embodiments can be made in various ways. The exit surface 308 according to example embodiments of the invention can be made from various materials, including acrylic, polycarbonate, glass, polyarylate, and many other transparent materials. The textured exit surface of the lens can be created in many ways. For example, a smooth surface could be roughened. The surface could be molded with textured features. Such a surface may be, for example, prismatic in nature. The exit surface according to embodiments of the invention can also consist of multiple parts co-molded or co-extruded together. For example, the textured surface could be another material co-molded or co-extruded with the portion of the lens with the substantially triangular concentric rings. A suitable lens for use as exit surface 308 in the lamp of the invention is disclosed in United States patent application entitled "Beam Shaping Lens and LED Lighting System Using Same", application Ser. No. 13/657,421, filed on Oct. 22, 2012, which is incorporated herein by reference in its entirety.

The reflectors as described herein may also be used in an omnidirectional lamp such as the A19 style of lamp shown, for example, in FIG. 1. In an omnidirectional lamp the reflector may be used to provide a greater degree of up lighting, i.e. light toward the free end of the lamp opposite the Edison connector, if desired. In an omnidirectional style lamp the reflector may be made of a semitransparent or translucent material such that some of the light is reflected but other light is allowed to pass through the reflector. Such an arrangement provides less directional reflection and a more omnidirectional pattern while still providing some light shaping.

It has been determined that during normal use of the lamp, the lamp undergoes thermal cycling. Where the heat sink 149, including heat conducting portion 152 on which the LED assembly 130 is mounted, and the metal in the LED assembly 130 are different materials, these components have different rates of thermal expansion such that these components expand and contract at different rates and in different amounts. The different thermal expansion rates of the LED assembly 130 and the heat conducting portion 152, combined with the fact that the LED assembly 130 is under radial tension on the heat conducting portion 152, may cause the LED assembly 130 to move slightly in an axial direction relative to the heat conducting portion 152. As used herein the term axial direction means that the LED assembly may move along the length of the heat conducting portion or tower 152 toward its free distal end. The LED assembly 130 will tend to move axially away from base 102 towards the free end of the heat conducting portion 152. Movement of the LED assembly 130 relative to the heat conducting portion 152 of the heat sink 149 may alter slightly the light pattern emitted from the lamp. Movement of the LED assembly 130 relative to the heat sink 149 and interconnect 150 may also adversely affect the electrical connection between the LED assembly 130 and the electrical interconnect 150 and/or the thermal coupling between the LED assembly 130 and the heat sink 149.

Figure 29:
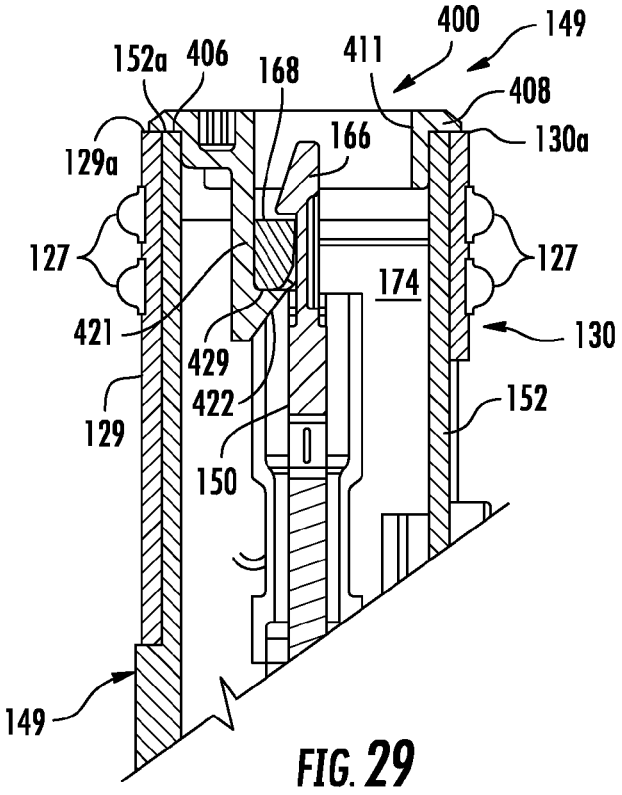
FIG. 29 is a detailed section view of the retention member of FIG. 28 mounted on the heat sink.
Figure 30:
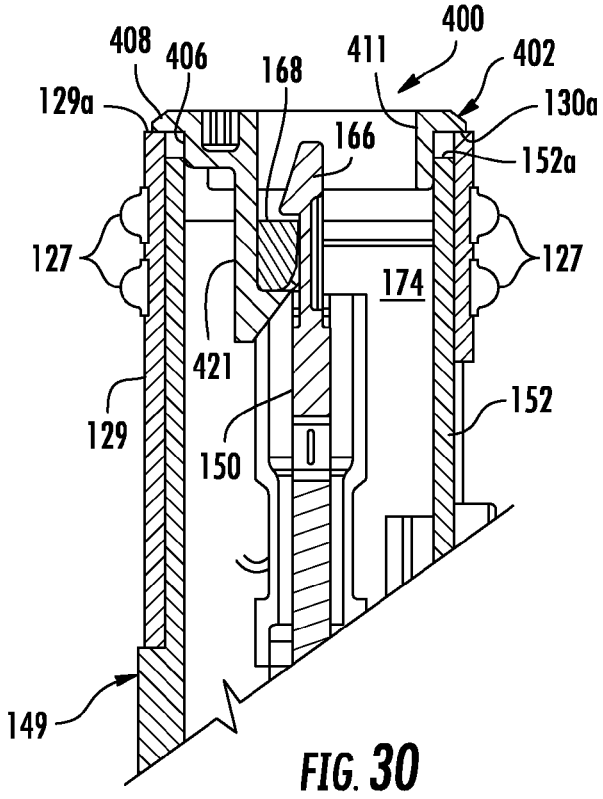
FIG. 30 is a detailed section view of an alternate embodiment of the retention member mounted in the heat sink.
Figure 31:
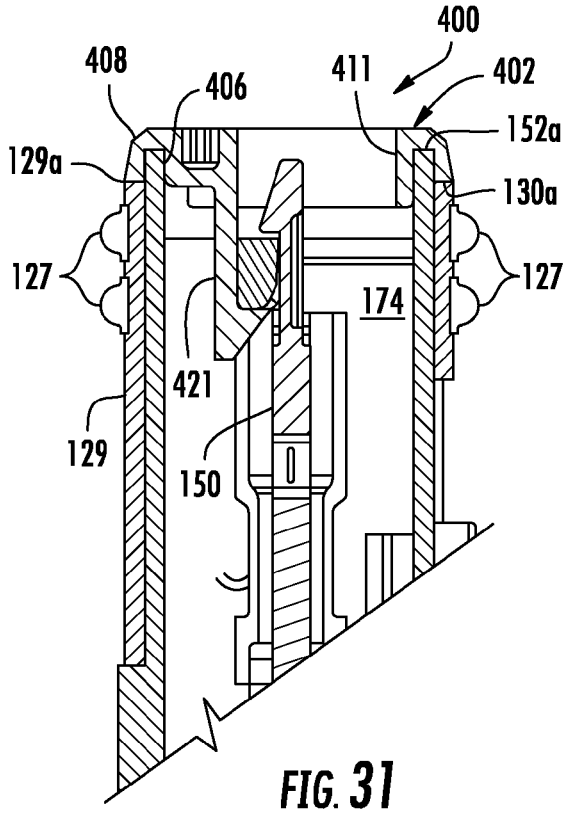
FIG. 31 is a detailed section view of an alternate embodiment of the retention member mounted in the heat sink.

To prevent axial movement of the LED assembly 130 relative to the heat sink 149 a retention member 400 is provided that fixes the axial position of the LED assembly 130 relative to the heat conducting portion 152 of heat sink 149 as shown in FIGS. 28-41. The retention member 400 may comprise a cap 402 that fits onto the heat conducting portion 152 and that engages the LED assembly 130. An engagement mechanism 404 fixes the retention member 400 to the heat sink 149. The cap 402 may fit over the end of the heat conducting portion 152. The cap 402 may include a seat 406 that is inserted into the cavity 174 of the heat conducting portion 152 and a flange 408 that extends from the seat 406 and that extends over the distal edge 152*a* of the heat sink 149 and the distal edge 130*a* of the LED assembly 130. The distal edge as used herein means the edges of the LED assembly, submount and/or heat sink that are located adjacent the free end of the heat conducting portion 152. In the illustrated embodiment the distal edge 129*a* of the submount 129 is also the distal edge 130*a* of the LED assembly 130. Because the heat conducting portion 152 is shaped generally as a tube having a generally cylindrical outer surface and a generally cylindrical cavity 174, the seat 406 and flange 408 may be formed to have mating annular or circular shapes. The seat 406 may form a relatively close fit with the cavity 174. The flange 408 may contact the distal edge 130*a* of the LED assembly 130 and the distal edge 152*a* of the heat conducting portion 152. In one embodiment, the distal edges 130*a*, 152*a* of the LED assembly 130 and the heat conducting portion 152 are coplanar such that the planar bottom surface of flange 408 contacts both components. Because the retention member 400 is used to prevent movement of the LED assembly 130 relative to the heat conducting portion 152, the cap 402 and flange 408 are configured to contact the distal edge 130*a* of the LED assembly 130. To the extent that the distal edge 130*a* of the LED assembly 130 and the distal end 152*a* of the heat conducting portion 152 are not coplanar the flange 408 may be configured other than as a planar member and may be configured to engage at least the distal edge 130*a* of the LED assembly 130. For example, as shown in FIG. 30 where the distal edge 130*a* of the LED assembly 130 extends beyond the distal edge 152*a* of the heat conducting portion 152, the flange 408 may be configured to contact the distal edge 130*a* of the LED assembly 130 without necessarily contacting the distal edge 152*a* of the heat conducting portion 152. In other embodiments, the flange 408 may have other than a planar bottom surface such that the flange may contact both the distal edge of the heat sink and the distal edge of the LED assembly even where these edges are not coplanar. And, for example, as shown in FIG. 31 where the distal edge 152*a* of the heat conducting portion 152 extends beyond the distal edge 130*a* of the LED assembly 130, the flange 408 may be configured to extend over the distal edge 152*a* of the heat conducting portion 152 and along the heat conducting portion 152 to contact the distal edge 130*a* of the LED assembly 130.

While in one embodiment the retention member 400 contacts the distal edge 130*a* of the LED assembly 130, the retention member may engage the LED assembly at a location other than the distal edge provided that the engagement of the retention member 400 with the LED assembly 130 prevents axial movement of the LED assembly 130 along the length of the heat conducting portion 152. For example, the retention member 400 may include nubs or projections that engage mating apertures or recesses formed on a side of the LED assembly 130.

The cap 402 may be formed as an annular ring such that an opening 411 may be formed in the cap that allows air to circulate into the interior of the heat sink 149 through the retention member 400. Allowing air to flow into the interior of the heat sink 149 may help to dissipate heat from the heat sink. In some embodiments the cap 402 may be made as a solid member rather than as an annular ring to prevent access to the interior of the heat sink.

In one embodiment the engagement mechanism 404 comprises a first engagement member on the retention member 400 that engages a mating second engagement member on the heat sink structure 149. The first and second engagement members may engage one another using a snap-fit connection. In one embodiment, the first engagement member comprises a deformable resilient finger 421 that comprises a camming surface 422 and a lock member 429. The second engagement member may comprise the fixed member 168 formed in the heat sink 149. As previously explained, fixed member 168 is used to connect the electrical interconnect 150 to the heat sink 149 using a snap-fit connection. In the illustrated embodiment, one finger 421 is provided although a greater number of fingers may be provided. The finger 421 may be made as one-piece with the cap 402. For example, the cap 402 and finger 421 may be molded of plastic. The fixed member 168 may be engaged by the lock member 429 to lock the retention member 400 to the heat sink 149. The retention member 400 may be inserted into the heat sink 149 such that finger 421 is inserted into the central cavity 174 of the heat conducting portion 152 and the camming surface 422 of the finger 421 contacts the fixed member 168. The engagement of the fixed member 168 with the camming surface 422 deforms the finger 421 to allow the lock member 429 to move past the fixed member 168. As the lock member 429 passes the fixed member 168 the finger 421 returns toward the undeformed state such that the lock member 429 is disposed behind the fixed member 168. The engagement of the lock member 429 with the fixed member 168 fixes the retention member 400 to the heat sink 149. The snap-fit connection allows the retention member 400 to be fixed to the heat sink 149 in a simple insertion operation without the need for any additional connection mechanisms, tools or assembly steps.

While one embodiment of the snap-fit connection is shown numerous changes may be made. For example, the deformable member, such as the finger 421, may be formed on the heat sink 149 and the fixed member may be formed on the retention member 400. Moreover, both engagement members may be deformable. Moreover the second engagement member on the heat sink 149 may be a stationary member on the heat sink or base other than member 168. Other snap-fit connection mechanisms may also be used. Further, rather than using a snap-fit connection, the retention member may be fixed to the heat sink 149 using other connection mechanisms such as a bayonet connection, screwthreads, friction fit, adhesive, welding or the like.

The retention member 400 is configured such that when the retention member is secured to the heat sink 149, the LED assembly 130 is constrained from movement along the axial direction of the heat sink 149 toward the free end of the heat conducting portion 152. While the engagement of the retention member 400 with the LED assembly 130 uses an abutting contact as shown in FIG. 29, these components may engage one another using a snap-fit connection, friction fit, mechanical engagement or the like.

Figure 32:
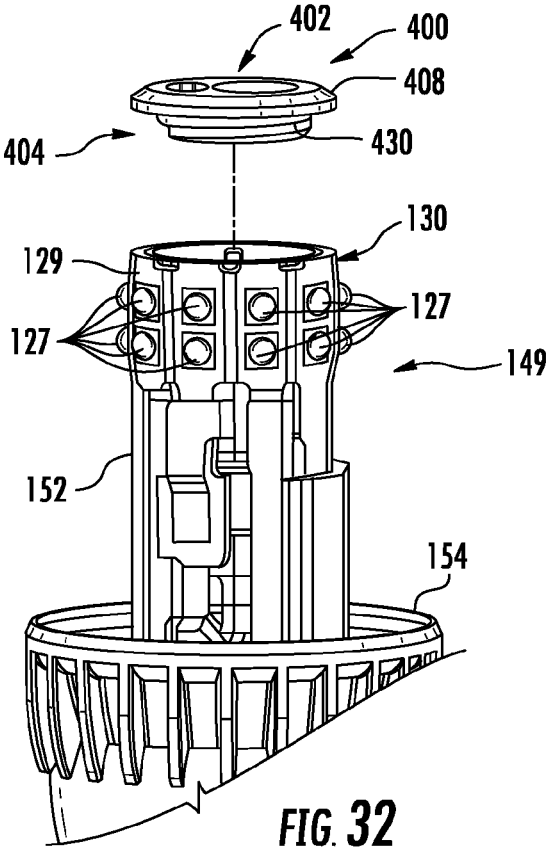
FIG. 32 is a detailed exploded perspective view of another embodiment of the retention member of the invention and a portion of the heat sink.
Figure 33:
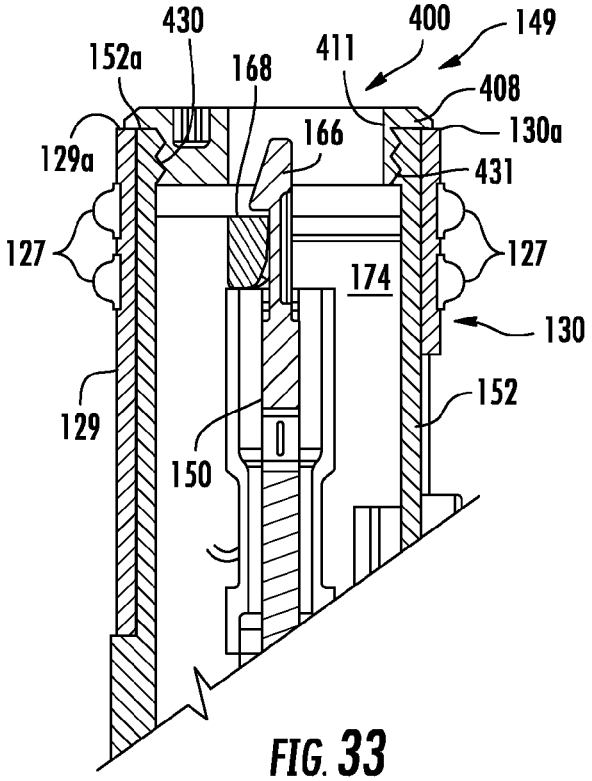
FIG. 33 is a detailed section view of the retention member of FIG. 32 mounted on the heat sink.

Referring to FIGS. 32 and 33 in another embodiment the retention member 400 may comprise a cap 402 that fits onto the heat conducting portion 152. The cap 402 may fit over the end of the heat conducting portion 152 and a flange 408 may extend over the distal edge 152*a* of the heat sink 149 and the distal edge 130*a* of the LED assembly 130 to engage the LED assembly 130 and hold it in position relative to the heat sink as previously described. An engagement mechanism 404 fixes the retention member 400 to the heat sink 149. The engagement mechanism 404 comprises a threaded post 430 that threadably engages threads 431 formed in the internal wall of cavity 174 of the heat conducting portion 152.

Figure 34:
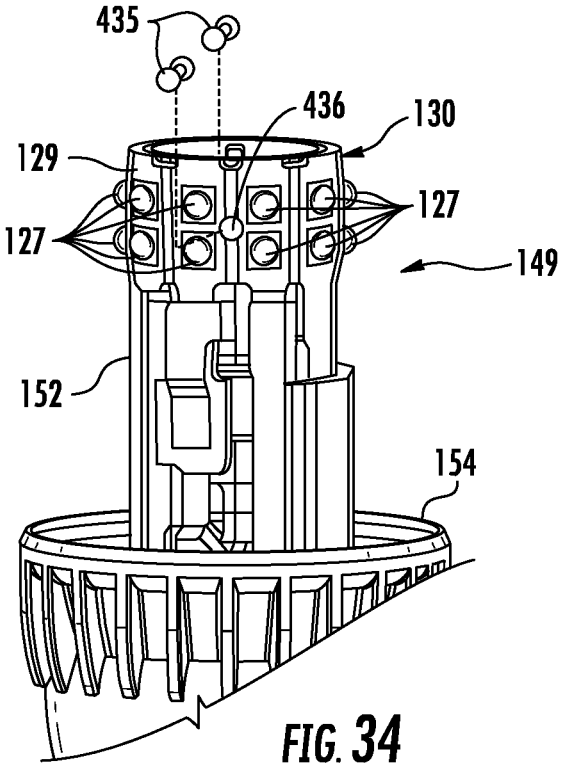
FIG. 34 is a detailed exploded perspective view of yet another embodiment of the retention member of the invention and a portion of the heat sink.
Figure 35:
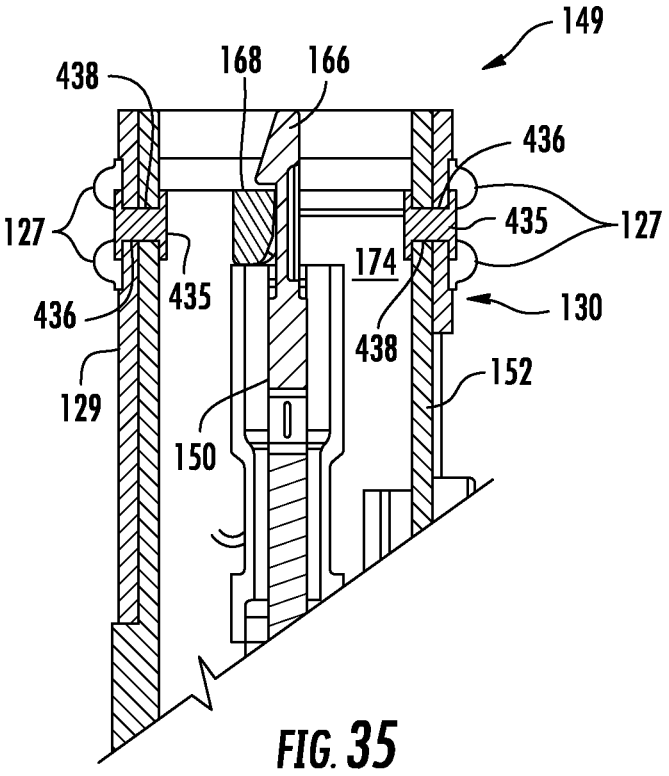
FIG. 35 is a detailed section view of the retention member of FIG. 34 mounted on the heat sink.
Figure 38:
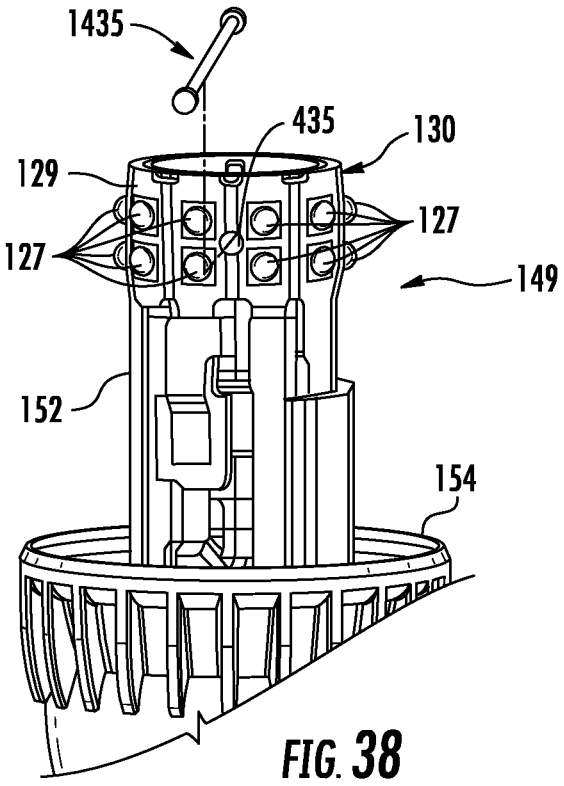
FIG. 38 is a detailed exploded perspective view of still another embodiment of the retention member of the invention and a portion of the heat sink.
Figure 39:
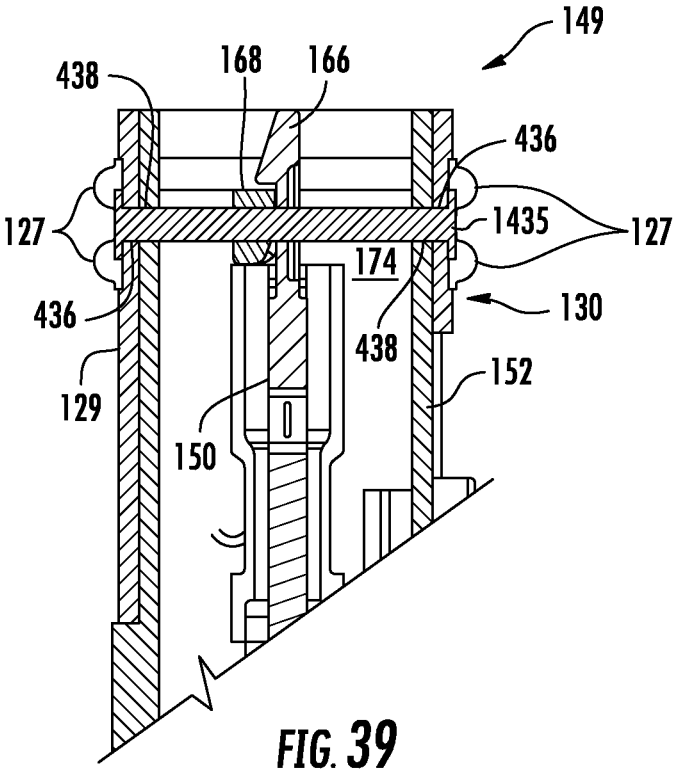
FIG. 39 is a detailed section view of the retention member of FIG. 38 mounted on the heat sink.

Referring to FIGS. 34 and 35 in another embodiment the retention member may comprise at least one pin 435 that engages mating apertures 436, 438 formed in the submount 129 and the heat conducting portion 152 of the heat sink 149, respectively. The pins 435 may be made of an electrically insulating material such as plastic and may engage the submount 129 and heat conducting portion 152 with a snap fit, friction fit, mechanical engagement mechanism, adhesive, welding or the like. While two pins 435 are illustrated a greater or fewer number of pins may be used. Moreover, a pin 1435 may extend entirely through the heat sink and LED assembly as shown in FIGS. 38 and 39. Pin 1435 mat extend through the finger 166 and fixed member 168 or it may extend to the side of these members.

Figure 36:
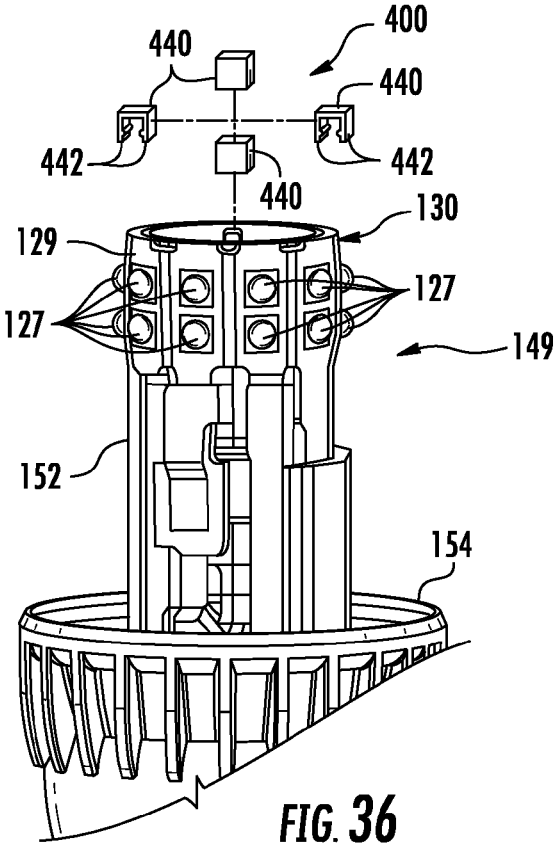
FIG. 36 is a detailed exploded perspective view of still another embodiment of the retention member of the invention and a portion of the heat sink.
Figure 37:
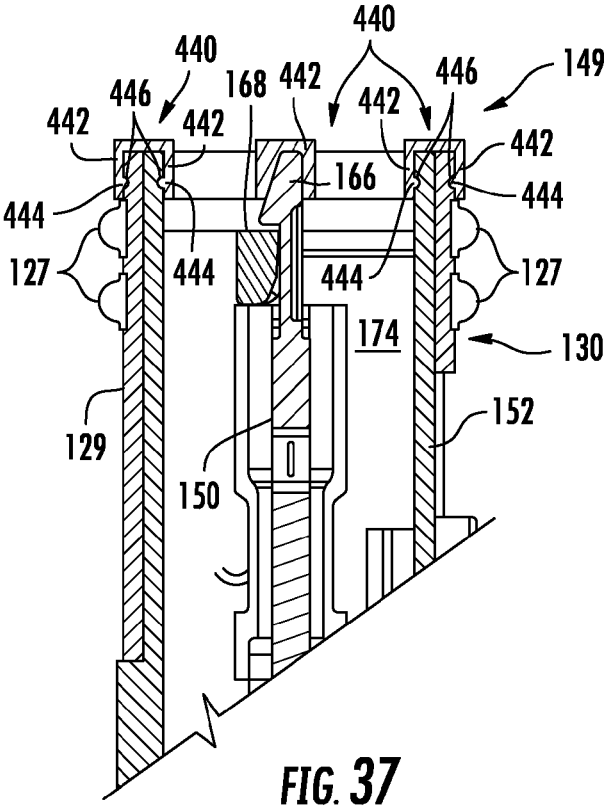
FIG. 37 is a detailed section view of the retention member of FIG. 36 mounted on the heat sink.
Figure 40:
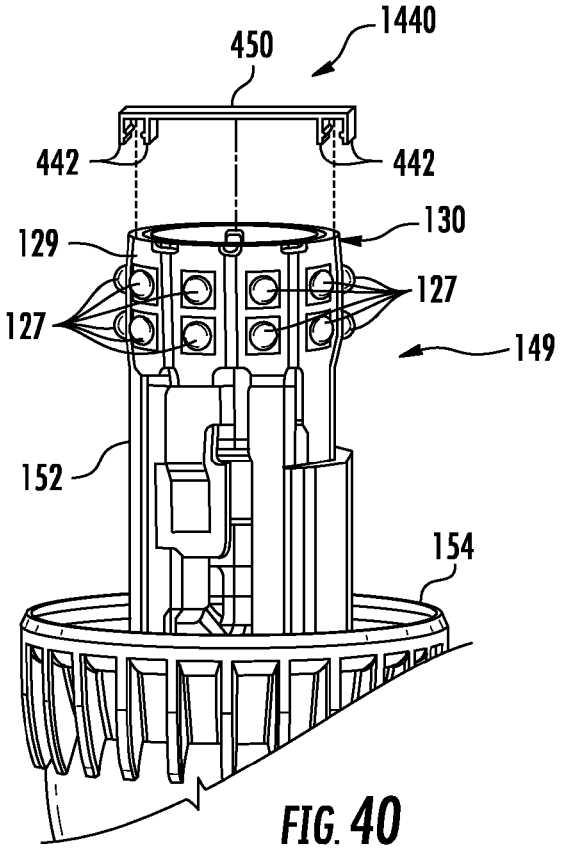
FIG. 40 is a detailed exploded perspective view of still another embodiment of the retention member of the invention and a portion of the heat sink.
Figure 41:
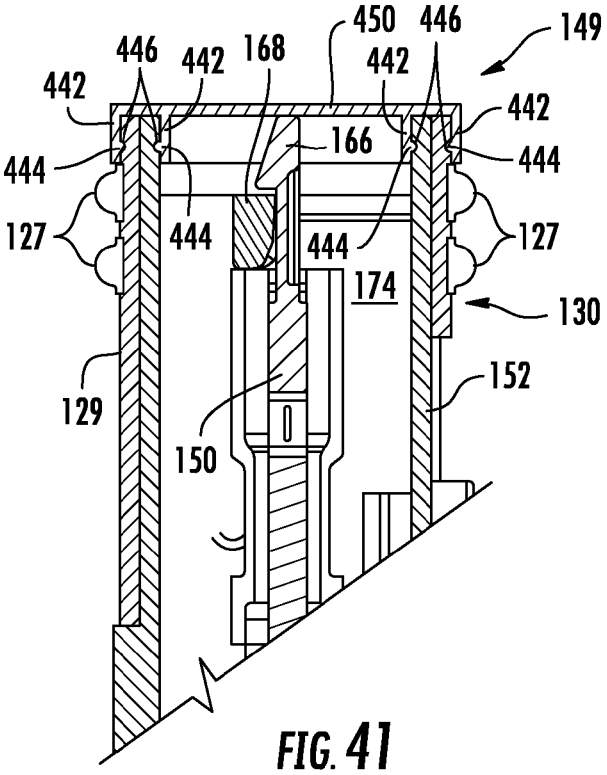
FIG. 41 is a detailed section view of the retention member of FIG. 40 mounted on the heat sink.

Referring to FIGS. 36 and 37 in another embodiment the retention member 400 may comprise a plurality of clips 440. The clips 440 engage the submount 129 and heat sink 152 such that the submount 129 is fixed in position relative to the heat sink 149. The clips 440 may be made of an elastic material such as plastic having opposed spaced arms 442 that receive the submount 129 and heat conducting portion 152 therebetween. The arms 442 may create a clamping force on the submount 129 and heat sink 149 to hold the LED assembly 130 in position relative to the heat sink 149. In some embodiments the arms 442 may comprise protrusions 444 that engage opposed recesses 446 formed on the submount 129 and heat sink 149 to create a mechanical engagement between these structures. In some embodiments the protrusions may be formed on heat sink 149 and LED assembly 130 and the recesses may be formed on the clips 442. The clips 442 may take various configurations provided that the LED assembly 130 is fixed in position relative to the heat sink 149. Referring to FIGS. 40 and 41 the clip 1440 may comprise a pair of clips 440 similar, to clips 440 described above, that are connected to one another by a cross member 450.

Figure 11:
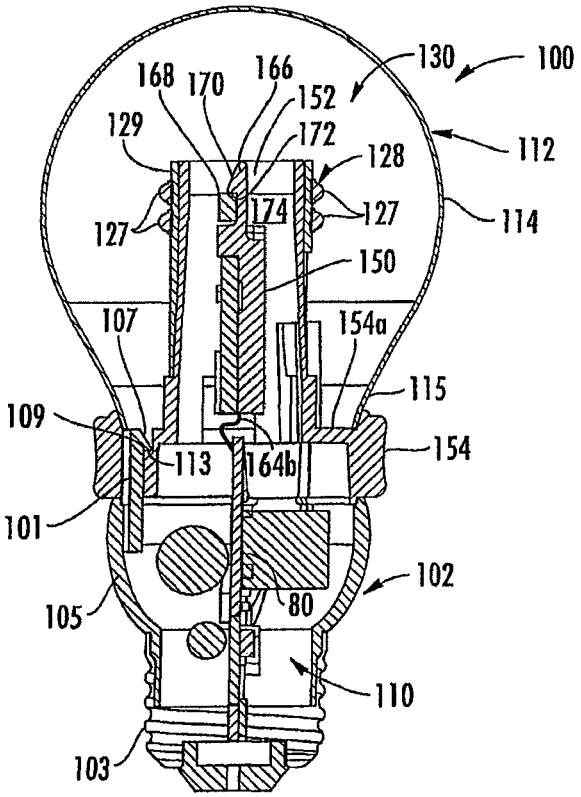
FIG. 11 is a section view similar to FIG. 4.

Once the heat sink/LED assembly subcomponent is completed, the subcomponent may be attached to the base 102 as a unit. First engagement members on the base 102 may engage mating second engagement members on the heat sink structure 149. In one embodiment, the first engagement members comprise deformable resilient fingers 101 that comprise a camming surface 107 and a lock member 109. The second engagement member comprises apertures 111 formed in the heat sink 149 that are dimensioned to receive the fingers 101. In one embodiment, the housing 105 of the base 102 is provided with fingers 101 that extend from the base 102 toward the subcomponent. In the illustrated embodiment three fingers 101 are provided although a greater or fewer number of fingers may be provided. The fingers 101 may be made as one-piece with the housing 105. For example, the housing 105 and fingers 101 may be molded of plastic. The apertures 111 define fixed members 113 that may be engaged by the lock members 109 to lock the fingers 101 to the heat sink 149. The base 102 may be moved toward the bottom of the heat sink 149 such that fingers 101 are inserted into apertures 111 and the the camming surfaces 107 of the fingers 101 contact the fixed members 113. The engagement of the fixed members 113 with the camming surfaces 107 deforms the fingers 101 to allow the locking members 109 to move past the fixed members 113. As the lock members 109 pass the fixed members 113 the fingers 101 return toward their undeformed state such that the lock members 109 are disposed behind the fixed members 113. The engagement of the lock members 109 with the fixed members 113 fixes the base 102 to the heat sink 149. The snap-fit connection allows the base 102 to be fixed to the heat sink 149 in a simple insertion operation without the need for any additional connection mechanisms, tools or assembly steps. While one embodiment of the snap-fit connection is shown numerous changes may be made. For example, the deformable members such as fingers may be formed on the heat sink 149 and the fixed members such as apertures may be formed on the base 102. Moreover, both engagement members may be deformable. Further, rather than using a snap-fit connection, the electrical interconnect 150 may be fixed to the heat sink using other connection mechanisms such as a bayonet connection, screwthreads, friction fit or the like. The fixed members 113 may be recessed below the upper surface of the heat dissipation portion 154 such that when the lock members 109 are engaged with the fixed members 113 the fingers 101 do not extend above the plane of the upper surface 154*a* of the heat dissipating portion 154 as best shown in FIG. 11.

As the base 102 is brought into engagement with the heat sink 149, electronic-side contacts 162*b*, 164*b* are inserted into the base 102. The lamp electronics 110 are provided with contact pads 96, 98 that are arranged such that when the base 102 is assembled to the heat sink 149, the electronic-side contacts 162*b*, 164*b* are in electrical contact with the pads 96, 98 to complete the electrical path between the base 102 and the LED assembly 130. The pads 96, 98 are disposed such that the electronic-side contacts 162*b*, 164*b* are deformed slightly such that the resiliency of the contacts exerts a biasing force that presses the contacts into engagement with the pads to ensure a good electrical connection. The electronic-side contacts 162*b*, 164*b* may be formed with angled distal ends 191 that act as camming surfaces to deform the contacts during assembly of the base to the heat sink. The camming surfaces may be arranged to contact a surface in the base, such as the PCB board 80, to deform the contacts upon insertion. The engagement between the electronics-side contacts of the electrical interconnect 150 and the pads on the lamp electronics is referred to herein as a contact coupling where the electrical coupling is created by the contact under pressure between the contacts and the pads as distinguished from a soldered coupling.

The enclosure 112 may be attached to the heat sink 149. In one embodiment, the LED assembly 130 and the heat conducting portion 152 are inserted into the enclosure 112 through the neck 115. The neck 115 and heat sink dissipation portion 154 are dimensioned and configured such that the rim of the enclosure 112 sits on the upper surface 154*a* of the heat dissipation portion 154 with the heat dissipation portion 154 disposed at least partially outside of the enclosure 112, between the enclosure 112 and the base 102. To secure these components together a bead of adhesive may be applied to the upper surface 154*a* of the heat dissipation portion 154. The rim of the enclosure 112 may be brought into contact with the bead of adhesive to secure the enclosure 112 to the heat sink 149 and complete the lamp assembly. In addition to securing the enclosure 112 to the heat sink 149 the adhesive is deposited over the snap-fit connection formed by fingers 101 and apertures 111. The adhesive flows into the snap fit connection to permanently secure the heat sink to the base.

In some embodiments, depending on the LEDs used, the exit surfaces of the enclosure may be made of glass which has been doped with a rare earth compound, in this example, neodymium oxide. Such an optical element could also be made of a polymer, including an aromatic polymer such as an inherently UV stable polyester. The exit surface is transmissive of light. However, due to the neodymium oxide in the glass, light passing through the dome of the optical element is filtered so that the light exiting the dome exhibits a spectral notch. A spectral notch is a portion of the color spectrum where the light is attenuated, thus forming a "notch" when light intensity is plotted against wavelength. Depending on the type or composition of glass or other material used to form the optical element, the amount of neodymium compound present, and the amount and type of other trace substances in the optical element, the spectral notch can occur between the wavelengths of 520 nm and 605 nm. In some embodiments, the spectral notch can occur between the wavelengths of 565 nm and 600 nm. In other embodiments, the spectral notch can occur between the wavelengths of 570 nm and 595 nm. Such systems are disclosed in U.S. patent application Ser. No. 13/341,337, filed Dec. 30, 2011, titled "LED Lighting Using Spectral Notching" which is incorporated herein by reference in its entirety.

Any aspect or features of any of the embodiments described herein can be used with any feature or aspect of any other embodiments described herein or integrated together or implemented separately in single or multiple components. The steps described herein may be performed in an automated assembly line having rotary tables or other conveyances for moving the components between assembly stations.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

An at least partially optically transmissive enclosure;

a base;

a LED assembly comprising at least one LED, the LED assembly being located in the enclosure and the at least one LED operable to emit light when energized through an electrical path from the base;

a heat sink comprising a heat conducting portion that extends in an axial direction and is thermally coupled to the at least one LED assembly, the LED assembly encircling the heat conducting portion; and a retention member for restraining the LED assembly from moving relative to the heat conducting portion in the axial direction.

2. The lamp of claim 1 wherein the retention member comprises a cap that fits over the top of the heat conducting portion.

3. The lamp of claim 2 wherein the cap includes a seat that is inserted into a cavity in the heat conducting portion.

4. The lamp of claim 2 wherein the cap includes a flange that extends from the seat and that extends over a distal edge of the heat sink and a distal edge of the LED assembly.

5. The lamp of claim 4 wherein the flange is configured to engage at least the distal edge of the LED assembly.

6. The lamp of claim 1 wherein the retention member includes a flange that extends over the distal edge of the LED assembly.

7. The lamp of claim 1 wherein the retention member comprises an engagement member that fixes the retention member to the heat sink.

8. The lamp of claim 1 wherein the retention member comprises a first engagement member that engages a mating second engagement member on the heat sink.

9. The lamp of claim 8 wherein one of the first engagement member and the second engagement member comprises a deformable resilient finger.

10. The lamp of claim 9 wherein the finger comprises a camming surface and a lock member.

11. The lamp of claim 8 wherein one of the first engagement member and the second engagement member comprises a fixed member formed on the heat sink.

12. The lamp of claim 11 wherein the fixed member supports an electrical interconnect that provides an electrical connection between the LED assembly and the base.

13. The lamp of claim 8 wherein the first and second engagement members form a snap-fit connection.

14. The lamp of claim 1 wherein the LED assembly comprises a submount on which the at least one LED is mounted wherein the submount is engaged by the retention member.

15. The lamp of claim 14 wherein the submount comprises at least one of a PCB, flex circuit, MCPCB, and lead frame.

16. The lamp of claim 14 wherein the submount has a three-dimensional shape where a portion of the tower is positioned inside of the submount and the plurality of LEDs are mounted on an outside surface of the submount.

17. The lamp of claim 14 wherein the submount comprises a flat member that is bent into a three-dimensional shape where the plurality of LEDs are mounted on an outside surface of the submount.

18. The lamp of claim 1 further wherein the heat conducting portion comprises a tower that extends along a longitudinal axis of the lamp and the LED assembly is mounted on the tower such that the at least one LED emits light laterally.

19. The lamp of claim 1 wherein the heat sink comprises a heat dissipating portion, the heat dissipating portion is located between the enclosure and the base.

20. The lamp of claim 1 wherein the heat sink is thermally coupled to the LED assembly for transmitting heat from the LED assembly to the ambient environment where the heat sink and the LED assembly are arranged such that the LED assembly is disposed substantially in the optical center of the enclosure.

21. The lamp of claim 20 wherein the at least one LED comprises a plurality of LEDs positioned in a band such that a high intensity area of light produced from the plurality of LEDs appears as a glowing line of light when energized.

22. A lamp comprising:

An at least partially optically transmissive enclosure;

a base;

a LED assembly comprising at least one LED, the LED assembly being located in the enclosure and the at least one LED operable to emit light when energized through an electrical path from the base;

a heat sink comprising a heat conducting portion that extends in an axial direction and is thermally coupled to the at least one LED assembly, the LED assembly encircling the heat conducting portion such that it is under radial tension; and a retention member for restraining the LED assembly from moving relative to the heat conducting portion in the axial direction.

* * * * *